US009204737B2

(12) United States Patent
Lamarre

(10) Patent No.: US 9,204,737 B2
(45) Date of Patent: Dec. 8, 2015

(54) MODULAR SHELVING SYSTEM

(71) Applicant: PRESENTOIRS ONE WAY INC., Terrebonne (CA)

(72) Inventor: Alain Lamarre, Terrebonne (CA)

(73) Assignee: PRESENTOIRS ONE WAY INC., Terrebonne, Quebec (CA)

( * ) Notice: Subject to any disclaimer, the term of this patent is extended or adjusted under 35 U.S.C. 154(b) by 0 days.

(21) Appl. No.: 14/624,345

(22) Filed: Feb. 17, 2015

(65) Prior Publication Data

US 2015/0157144 A1 Jun. 11, 2015

Related U.S. Application Data

(63) Continuation of application No. PCT/CA2014/050353, filed on Apr. 7, 2014.

(60) Provisional application No. 61/809,662, filed on Apr. 8, 2013.

(51) Int. Cl.
*A47F 5/11* (2006.01)
*B65D 19/44* (2006.01)
(Continued)

(52) U.S. Cl.
CPC ..... *A47F 5/108* (2013.01); *A47B 47/0083* (2013.01); *A47F 5/0018* (2013.01); *A47F 5/11* (2013.01); *B65D 19/44* (2013.01); *B65D 2519/00676* (2013.01)

(58) Field of Classification Search
CPC .... A47B 45/00; A47B 47/00; A47B 47/0083; A47B 47/02; A47B 47/04; A47B 47/045; A47F 5/0018; A47F 5/0025; A47F 5/10; A47F 5/101; A47F 5/106; A47F 5/108; A47F 5/11; A47F 5/114; B65D 19/44; B65D 2519/00676
USPC ..... 211/126.15, 187, 189, 190, 191, 207
See application file for complete search history.

(56) References Cited

U.S. PATENT DOCUMENTS 11,449 A * 8/1854 Willard ..... 5/9.1
2,068,771 A 1/1937 Sherman
(Continued)

FOREIGN PATENT DOCUMENTS

DE 202007001060 U1 5/2007
FR 2542594 A1 9/1984
(Continued)

OTHER PUBLICATIONS

Written opinion for PCT/CA2014/050353 mailed on Jul. 9, 2014 by the Canadian Intellectual Property Office.
(Continued)

*Primary Examiner* — Joshua Rodden
(74) *Attorney, Agent, or Firm* — IPAXIO S.E.N.C.

(57) ABSTRACT

The modular shelving system includes a shelf assembly having a plurality of elongated horizontally-extending side rails. At least some of the side rails include at least one open-ended first through slot, each first through slot extending lengthwise on a horizontally-projecting side rail strip along a common junction from a corresponding one of the side rail ends. The shelving system also includes a plurality of elongated vertically-extending corner posts to which the side rail ends are connected to form a self-standing skeletal structure. Each corner post has at least two open-ended second through slots located at a given distance in-between the corner post ends and that each extend perpendicularly from a corresponding side edge towards a common junction of the corner post. Each first through slot forms a detachable interdigitated and load-bearing engagement with a corresponding one of the second through slots to support the shelf assembly.

26 Claims, 40 Drawing Sheets

(51) Int. Cl.

| | |
|---|---|
| ***A47F 5/10*** | (2006.01) |
| ***A47B 47/00*** | (2006.01) |
| ***A47F 5/00*** | (2006.01) |

(56) References Cited

U.S. PATENT DOCUMENTS

| | | | | | |
|---|---|---|---|---|---|
| 3,081,139 | A | * | 3/1963 | Hines et al. | 312/351 |
| 3,294,250 | A | * | 12/1966 | Evans | 211/190 |
| 3,337,111 | A | | 8/1967 | Petriekis et al. | |
| 3,339,750 | A | * | 9/1967 | Nelson-Hawkins | 211/191 |
| 3,433,354 | A | | 3/1969 | Liebel | |
| 3,536,245 | A | | 10/1970 | Palmer | |
| 3,559,339 | A | * | 2/1971 | Worley | 47/45 |
| 3,647,080 | A | | 3/1972 | Denny | |
| 3,734,389 | A | | 5/1973 | Brown | |
| 3,846,944 | A | * | 11/1974 | Lambert | 52/236.3 |
| 3,862,691 | A | * | 1/1975 | Mori et al. | 211/191 |
| 3,948,581 | A | | 4/1976 | Helman et al. | |
| 4,034,683 | A | * | 7/1977 | DiCenzo | 108/107 |
| 4,039,132 | A | | 8/1977 | Fournier | |
| 4,235,493 | A | | 11/1980 | Bridges et al. | |
| 4,270,661 | A | * | 6/1981 | Rosenband | 211/59.2 |
| 4,342,397 | A | * | 8/1982 | Halstrick | 211/191 |
| 4,545,490 | A | * | 10/1985 | Hsiao et al. | 211/191 |
| 4,549,665 | A | | 10/1985 | Smitley | |
| 4,712,695 | A | * | 12/1987 | Cheng | 211/191 |
| 4,771,893 | A | | 9/1988 | Liebel | |
| 4,852,501 | A | | 8/1989 | Olson et al. | |
| 4,856,434 | A | | 8/1989 | Smith | |
| 4,865,201 | A | | 9/1989 | Liebel | |
| 4,949,648 | A | * | 8/1990 | Miller | 108/107 |
| 4,973,110 | A | | 11/1990 | Nyquist | |
| 5,048,689 | A | | 9/1991 | McFarland | |
| 5,096,648 | A | | 3/1992 | Johnson et al. | |
| 5,181,611 | A | | 1/1993 | Liebel | |
| 5,267,651 | A | | 12/1993 | Hughes | |
| 5,351,846 | A | | 10/1994 | Carter | |
| 5,452,812 | A | | 9/1995 | Niequist et al. | |
| 5,553,549 | A | * | 9/1996 | Nilsson | 108/110 |
| 5,632,390 | A | | 5/1997 | Podergois | |
| 5,813,737 | A | * | 9/1998 | Stone | 312/257.1 |
| 5,979,338 | A | | 11/1999 | Salmanson et al. | |
| 6,378,710 | B1 | | 4/2002 | Grueneberg | |
| 6,540,080 | B2 | | 4/2003 | Moreyra | |
| 6,814,529 | B2 | | 11/2004 | Junge | |
| 6,968,962 | B2 | | 11/2005 | Toma | |
| 6,976,732 | B2 | | 12/2005 | Thomas et al. | |
| 8,251,222 | B2 | | 8/2012 | Rego Garcia De Alba | |
| 8,276,753 | B2 | | 10/2012 | Garcia De Alba | |
| 2002/0195029 | A1 | | 12/2002 | Walton | |
| 2002/0195410 | A1 | * | 12/2002 | Lin | 211/190 |
| 2005/0103734 | A1 | * | 5/2005 | Saltzberg et al. | 211/187 |
| 2006/0032412 | A1 | | 2/2006 | Harner et al. | |
| 2006/0144809 | A1 | * | 7/2006 | Collins et al. | 211/191 |
| 2009/0038989 | A1 | | 2/2009 | Rego Garcia De Alba | |
| 2010/0187226 | A1 | | 7/2010 | Rego Garcia De Alba | |
| 2011/0011312 | A1 | | 1/2011 | Rego Garcia De Alba | |
| 2011/0272373 | A1 | * | 11/2011 | Wojtowicz et al. | 211/134 |
| 2012/0248949 | A1 | | 10/2012 | Herman Baran et al. | |
| 2013/0019453 | A1 | | 1/2013 | Berent et al. | |

FOREIGN PATENT DOCUMENTS

| | | | |
|---|---|---|---|
| FR | 2582286 | A1 | 11/1986 |
| FR | 2690898 | A1 | 11/1993 |
| GB | 144765 | A | 6/1920 |
| GB | 890764 | A | 3/1962 |
| GB | 2232426 | A | 12/1990 |
| GB | 2334202 | A | 8/1999 |
| GB | 2492137 | A | 12/2012 |
| JP | 2007000409 | A | 1/2007 |
| WO | 9004688 | A2 | 5/1990 |
| WO | 2011045624 | A1 | 4/2011 |
| WO | 2012053971 | A1 | 4/2012 |
| WO | 2014165988 | A1 | 10/2014 |

OTHER PUBLICATIONS

Machine translation in English of FR-2542594 A1.
Machine translation in English of FR-2582286 A1.
Machine translation in English of FR-2690898 A1.
Machine translation in English of WO 2011/45624 A1.
Machine translation in English of DE 20 2007 001 060 U1.
Machine translation in English of JP 2007000409 A.

* cited by examiner

MODULAR SHELVING SYSTEM

CROSS-REFERENCE TO PRIOR APPLICATIONS

The present case is a continuation of PCT Application No. PCT/CA2014/050353 filed on 7 Apr. 2014. PCT/CA2014/050353 claims the benefit of U.S. patent application No. 61/809,662 filed on 8 Apr. 2013. The entire contents of these two prior applications are incorporated by reference.

TECHNICAL FIELD

The technical field relates generally to modular shelving systems and similar structures.

BACKGROUND

Various arrangements have been suggested over the years to provide low cost shipping and displaying devices that can be assembled and disassembled when needed. Most of these devices can be used for shipping, storing and ultimately displaying items at the point-of-sale. They are often used in conjunction with pallets, for instance wooden pallets, to facilitate their handling using a forklift or a similar apparatus. The devices provide one or more shelves on which the items are put before shipping. They provide an alternative to the stacking of the items over one another, which is not always appropriate or even possible. Some items, for instance fresh cut flowers or plants, to name just a few, cannot be stacked as regular boxes. Shipping and displaying devices are thus very useful for transporting and handling a wide range of items.

While many existing devices have proved to be very useful and handy, none were found to be entirely satisfactory for various reasons. There are continuous challenges in the design of these devices, such as the reduction of the assembly time, the reduction of the number of required parts and the reduction of the overall complexity of the assembly, particularly when specialized tools and/or workers with specialized skills are needed for assembling a device. Increasing the loading capacity of the devices and reducing the costs of the materials are also generally among the challenges. Still, optimizing the finger space can be another example of a challenge. The finger space can be broadly defined as the distance from the top of the items on one layer and the underside of the shelf that is immediately above. Maximizing the finger space when the device is also used to display the items at the point-of-sale will help the customers in finding and retrieving the items they want to buy. The various challenges are often difficult to meet without conflicting with another one or creating new challenges to be solved.

Examples of shipping and displaying devices can be found for instance in FR-2582286, U.S. Pat. No. 5,979,338, U.S. Pat. No. 8,251,222, U.S. Pat. No. 8,276,743, US-2009/0038989, US-2010/0187226, US-2011/0011312 and US-2012/0248949.

Overall, room for improvements always exists in this technical area.

SUMMARY

In one aspect, there is provided a modular shelving system including: a shelf assembly, the shelf assembly including a plurality of elongated horizontally-extending side rails, each side rail having two opposite ends and a body that is formed by two substantially perpendicular and flat strips integrally connected to one another along a common junction, one of the side rail strips being a vertically-projecting side rail strip and the other one being a horizontally-projecting side rail strip, each side rail further including an inner side and an outer side, at least some of the side rails including at least one open-ended first through slot, each first through slot extending lengthwise on the horizontally-projecting side rail strip along the common junction from a corresponding one of the side rail ends; and a plurality of elongated vertically-extending corner posts to which the side rail ends are connected to form a self-standing skeletal structure, each corner post having two opposite ends, an inner side, an outer side and a body that is formed by two substantially flat strips integrally connected to one another along a common junction, each corner post strip having a side edge extending lengthwise and at least one open-ended second through slot located at a given distance in-between the corner post ends and that extends perpendicularly from the side edge towards the common junction of the corner post, each first through slot forming a detachable interdigitated and load-bearing engagement with a corresponding one of the second through slots to support the shelf assembly.

In another aspect, there is provided a modular shelving system including: a quadrilateral shelf assembly, the shelf assembly including at least four elongated horizontal side rails, each side rail having two opposite ends and a L-shaped cross section that is formed by two substantially perpendicular and flat strips integrally connected to one another along a common junction, each side rail further including an inner side, an outer side and two open-ended first through slots, each first through slot of each side rail extending lengthwise along the common junction from a respective one of the side rail ends towards the other side rail end of the corresponding side rail; and four elongated vertical corner posts, each corner post having two opposite ends, an inner side, and outer side and a L-shaped cross section that is formed by two substantially perpendicular and flat strips integrally connected to one another along a common junction, each corner post strip having a side edge extending lengthwise and an open-ended second through slot located at a given distance in-between the corner post ends and that extends perpendicularly from the side edge towards the common junction of the corner post, the second through slots of the corner posts being configured and disposed for detachable interdigitated engagement with the first through slots of the side rails to support the shelf assembly, each corner post strip being insertable within a corresponding one of the side rail ends.

In another aspect, there is provided a method of assembling a modular shelving system, as disclosed and/or shown and/or suggested herein.

Further details on these aspects as well as other aspects of the proposed concept will be apparent from the following detailed description and the appended figures.

DETAILED DESCRIPTION

Figure 1:
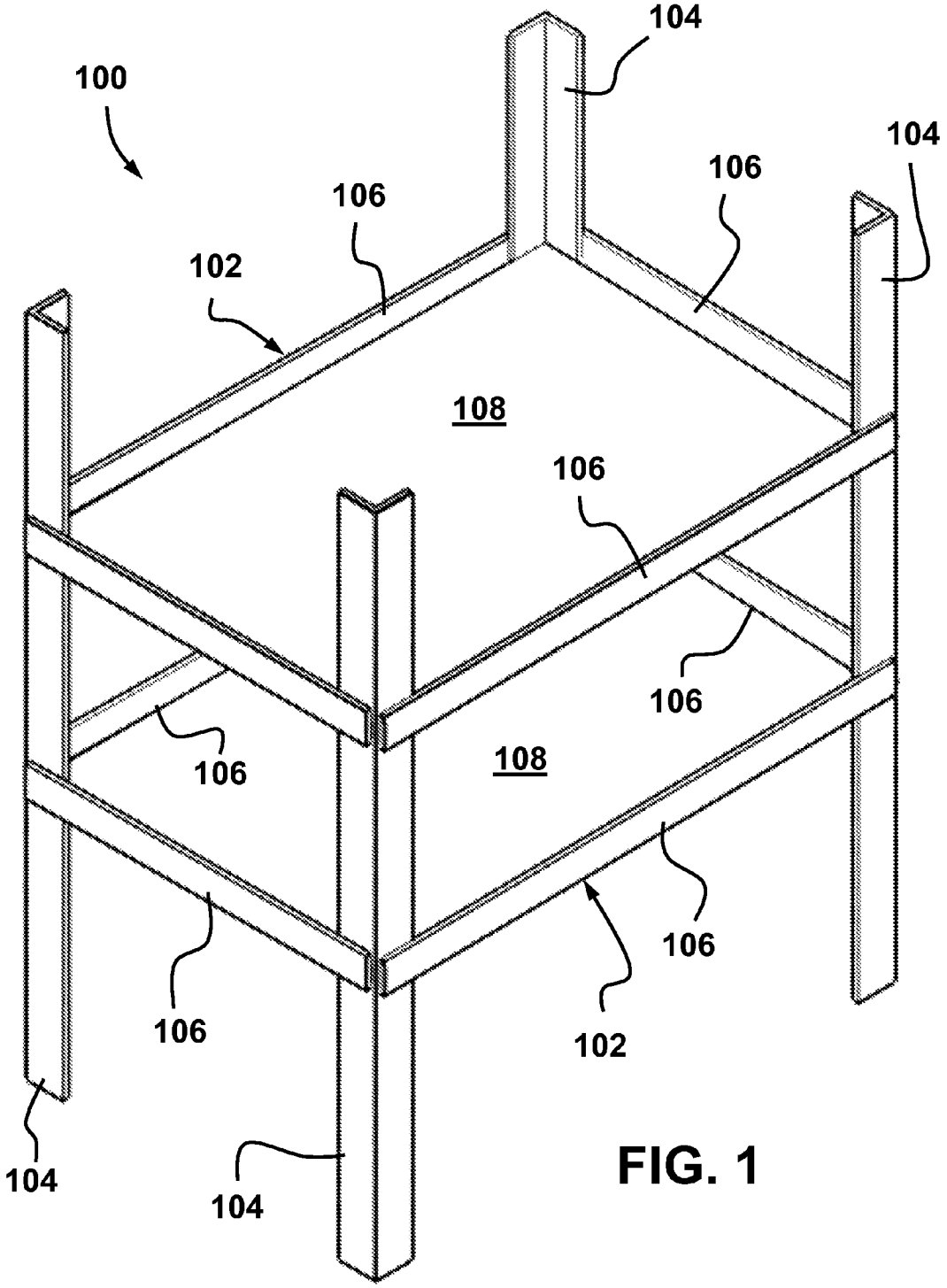
FIG. 1 is an isometric view illustrating an example of a modular shelving system incorporating the proposed concept.

FIG. 1 is an isometric view illustrating an example of a modular shelving system 100 incorporating the proposed concept. Many other examples can be devised based on this concept.

In the example illustrated in FIG. 1, the shelving system 100 includes two spaced-apart quadrilateral shelf assemblies 102, each being located at a given height from the floor surface. The shelf assemblies 102 are supported by four vertical corner posts 104. The shelving system 100 can include only one shelf assembly 102 or can include more than two shelf assemblies 102, depending on the implementation. Each shelf assembly 102 extends generally horizontally when the shelving system 100 is fully assembled, as shown in FIG. 1.

Each shelf assembly 102 of the illustrated example includes at least four elongated horizontal side rails 106 that are L-shaped in cross section. Each side rail 106 includes an inner side and an outer side. The inner side of the side rails 106 faces upwards when this shelving system 100 is fully assembled.

FIG. 1 also shows the shelf assemblies 102 supporting a corresponding flat and substantially rigid board 108, for instance one made of plywood or the like, that rests on the inner side of the side rails 106. Other arrangements are also possible, for instance using a grate or other kinds of boards fitting tightly in-between the side rails 106. It should be noted that the boards 108 are optional parts of the shelf assemblies 102 that can be purchased or otherwise provided separately. Some implementations may not even need a board, for instance if one uses trays or the like. A shelf assembly 102 can also be used to support an equipment fitting over the side rails 106 without necessarily using a board or the like.

Figure 2:
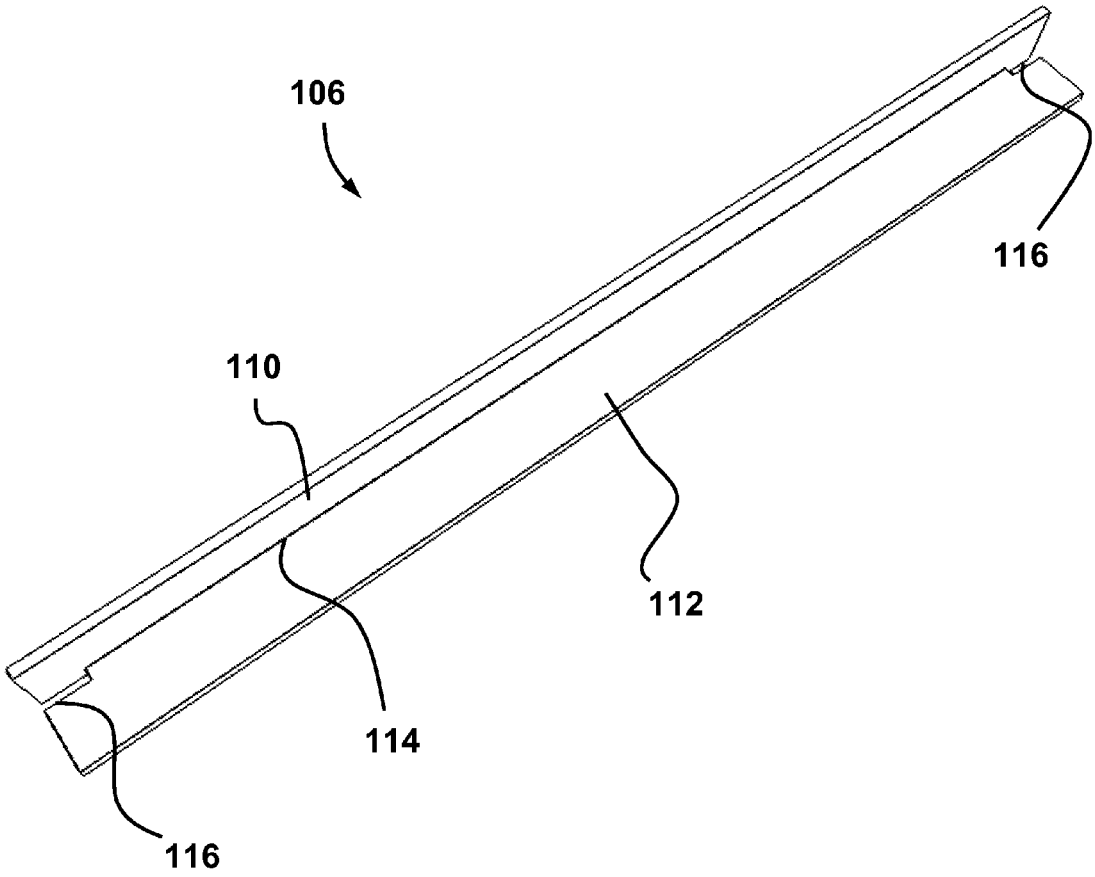
FIG. 2 is an isometric view of one of the side rails shown in FIG. 1.

FIG. 2 is an isometric view of one of the side rails 106 shown in FIG. 1. As can be seen, the illustrated side rail 106 includes a body made of two substantially perpendicular and flat strips 110, 112 integrally connected to one another along a common junction 114, forming an L-shaped cross section. The side rail strip 110 will project substantially vertically and the side rail strip 112 will project substantially horizontally in the example of FIG. 1 once the parts of the shelving system 100 as assembled.

The side rail 106 can be made of a one-piece material, for instance a laminated material. Examples of laminated materials include ones made of a plurality of laminated layers of fiberboard, paperboard and cardboard, to name just of few, forming a reinforced lightweight and substantially rigid product capable of supporting loads as required by most implementations. They are also relatively easy to machine and can be mass-produced at a relatively low cost. Nevertheless, other materials can be used as well. Using extruded plastic materials or even metallic materials for at least some of the parts is also possible.

The side rail 106 further includes two open-ended first through slots 116, one for each of the opposite ends of the side rail 106. Each first through slot 116 extends lengthwise along the common junction 114 from a respective one of the side rail ends towards the other side rail end. The first through slots 116 have a periphery that is substantially rectilinear and substantially rectangular in cross section, and are all identical in the illustrated example. In the example of FIG. 1, they are provided on the strip 112 that will extend substantially horizontally once the shelving system 100 is fully assembled. Variants are possible.

Figure 3:
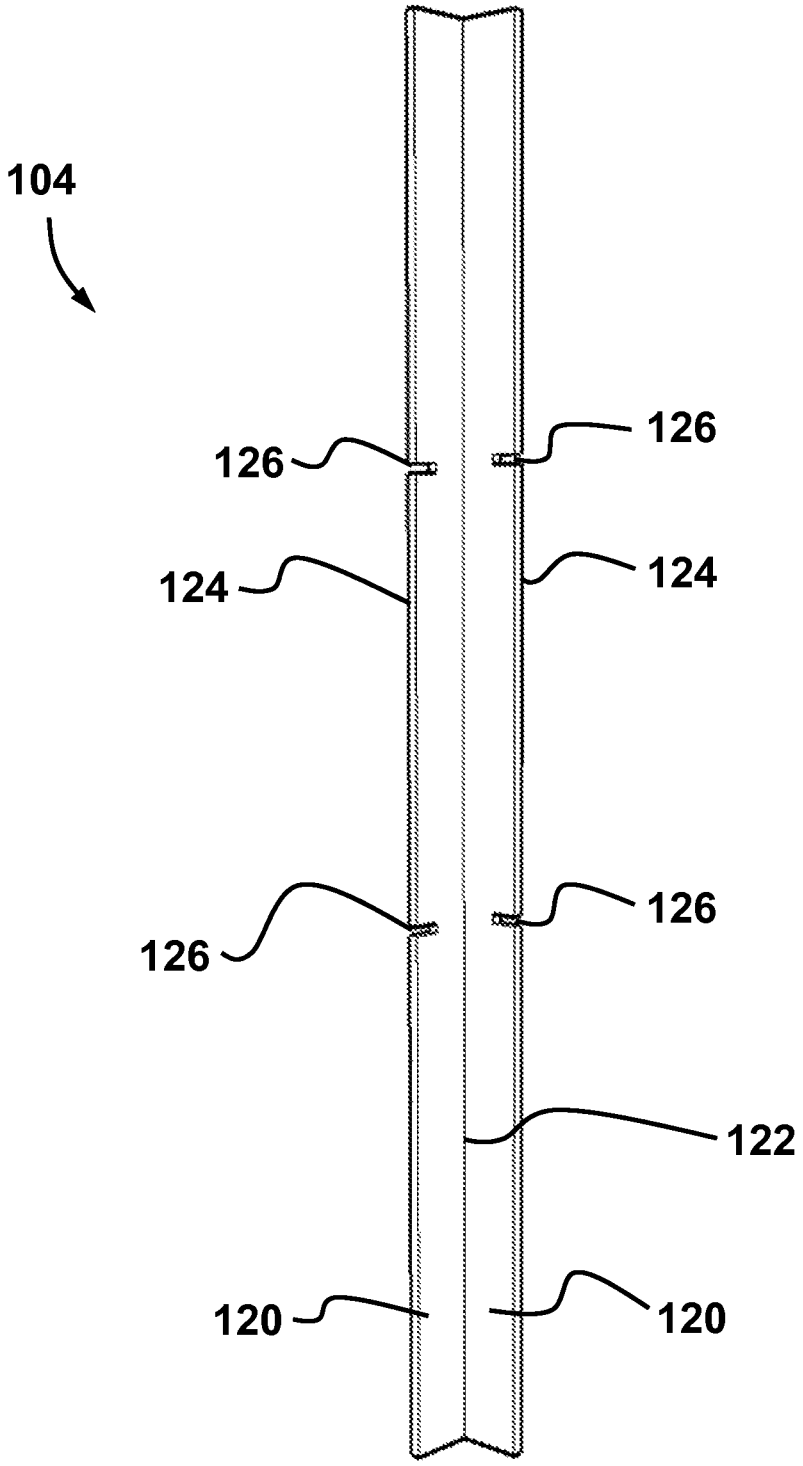
FIG. 3 is an isometric view of one of the corner posts shown in FIG. 1.

FIG. 3 is an isometric view of one of the corner posts 104 shown in FIG. 1. As can be seen, each corner post 104 in the example of FIG. 1 has an L-shaped body formed by two substantially perpendicular and flat strips 120 integrally connected to one another along a common junction 122. The corner post 104 extends rectilinearly between its two opposite ends. Variants are possible as well. The corner post 104 also includes an inner side and outer side.

The corner post 104 can be made of a material identical or similar to the side rail 104, for instance a one-piece material that can be a laminated and substantially rigid material. One can also use different materials for the side rail 106 and the corner post 104.

Each corner post strip 120 has a side edge 124 extending lengthwise. The side edges of the corner post strips 120 are rectilinear and parallel to one another in the illustrated example. Each corner post strip 120 also includes one or more open-ended second through slots 126 located at given distances between the corner post ends. There is at least one second through slot 126 in each corner post strip 120 for each shelf assembly 102 of the shelving system 100. However, one can provide more second through slots 126 than the number of actual shelf assemblies 102 for height adjustment purposes and/or for a wider height selection at the assembly time. Each second through slot 126 extends perpendicularly from the side edge 124 of the corresponding corner post strip 120 towards the common junction 122. They extend rectilinearly approximately half-way of the width of the strips 120, have a periphery that is substantially rectilinear and substantially rectangular in cross section, and are all identical in the illustrated example. The arrangement also provides a right angle connection between the horizontally-projecting side rail strip 112 of each side rail 106 and the corresponding corner post strip 120. Variants are also possible.

Figure 4:
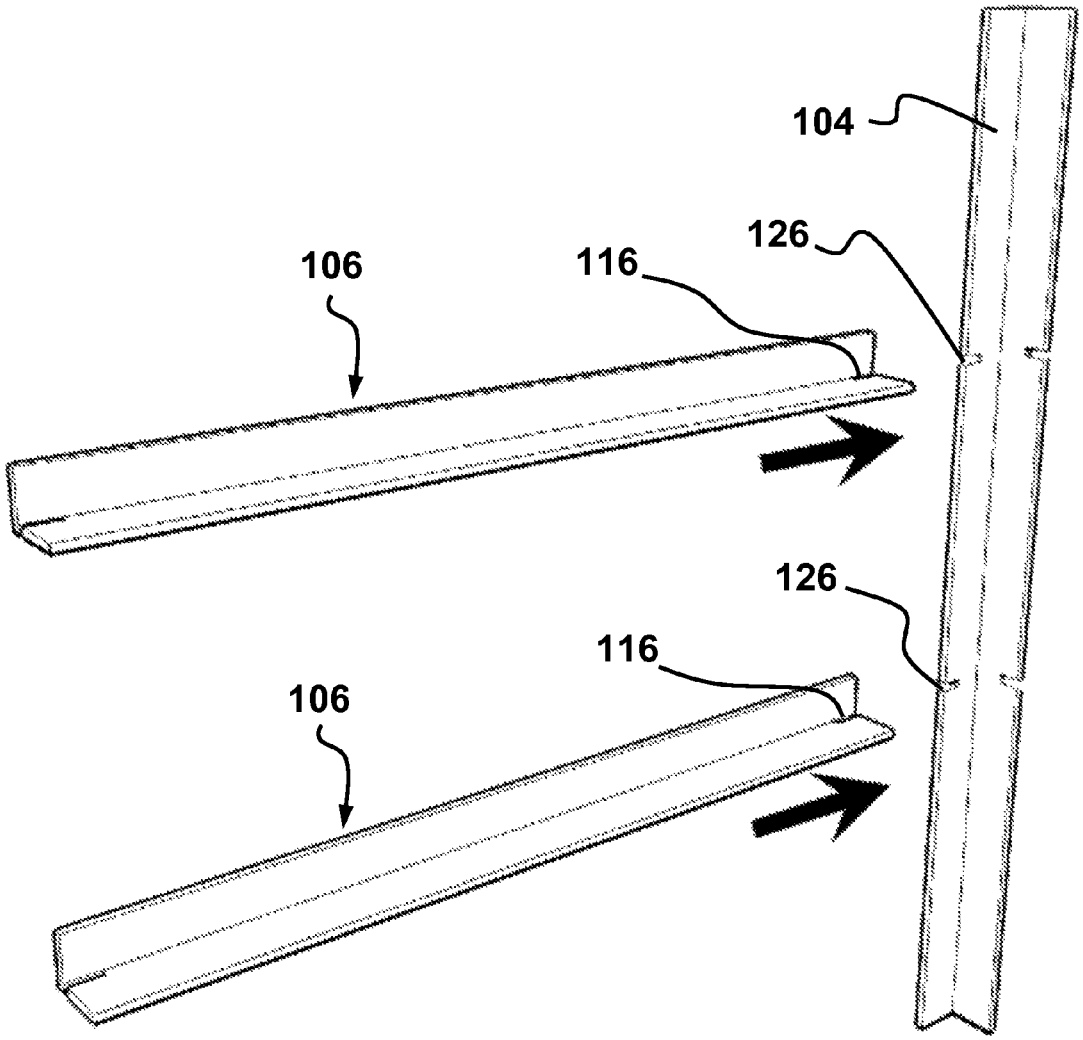
FIG. 4 is an isometric view illustrating how the side rails are connected to one of the corner posts to obtain the shelving system of FIG. 1.

FIG. 4 is an isometric view illustrating how the side rails 106 are connected to a corresponding one of the corner posts 104 to obtain the shelving system 100 of FIG. 1. In FIG. 4, the side rails 106 are already positioned substantially horizontally while the corner post 104 is already positioned substantially vertically. The side rails 106 are oriented so that their inner side faces be upwards. Thus, the horizontally-projecting side rail strip 112 of the illustrated side rails 106 projects inwards from the common junction 114 with reference to the shelving system 100 being assembled, and the corresponding vertically-projecting strip 110 projects upwards from the common junction 114. Variants are also possible. Still, it should be noted that one can assemble the shelving system 100 differently, for instance with the corner posts 104 being horizontal, and put the shelving system 100 in an upright position when it is fully assembled.

As can be seen, the first through slots 116 of the side rails 106 are configured and disposed for creating a detachable interdigitated and load-bearing engagement with a corresponding one of the second through slots 126 of the corner posts 126 when the side rail ends of connected to the corner posts 104 to support the corresponding shelf assembly 102 when the shelving system 100 is fully assembled. The weight of each side rail 106 and the weight of the items they will support are transmitted to corresponding ones of the corner posts 104.

The length of the first through slots 116 and the length of the second through slots 126 are complimentary, thereby allowing the bottom of the first through slots 116 to engage the bottom of their corresponding second through slots 126 when the interdigitated engagement is made. The edge at the tip of the side rail 106 then abuts against the inner side of the corresponding corner post strip 120. The rest of the periphery of the first through slots 116 will be in direct contact with surfaces of the corresponding corner posts 104 and the rest of the periphery of the second through slots 126 will be in direct contact with surfaces of the corresponding horizontally-projecting side rail strip 112.

Figure 5:
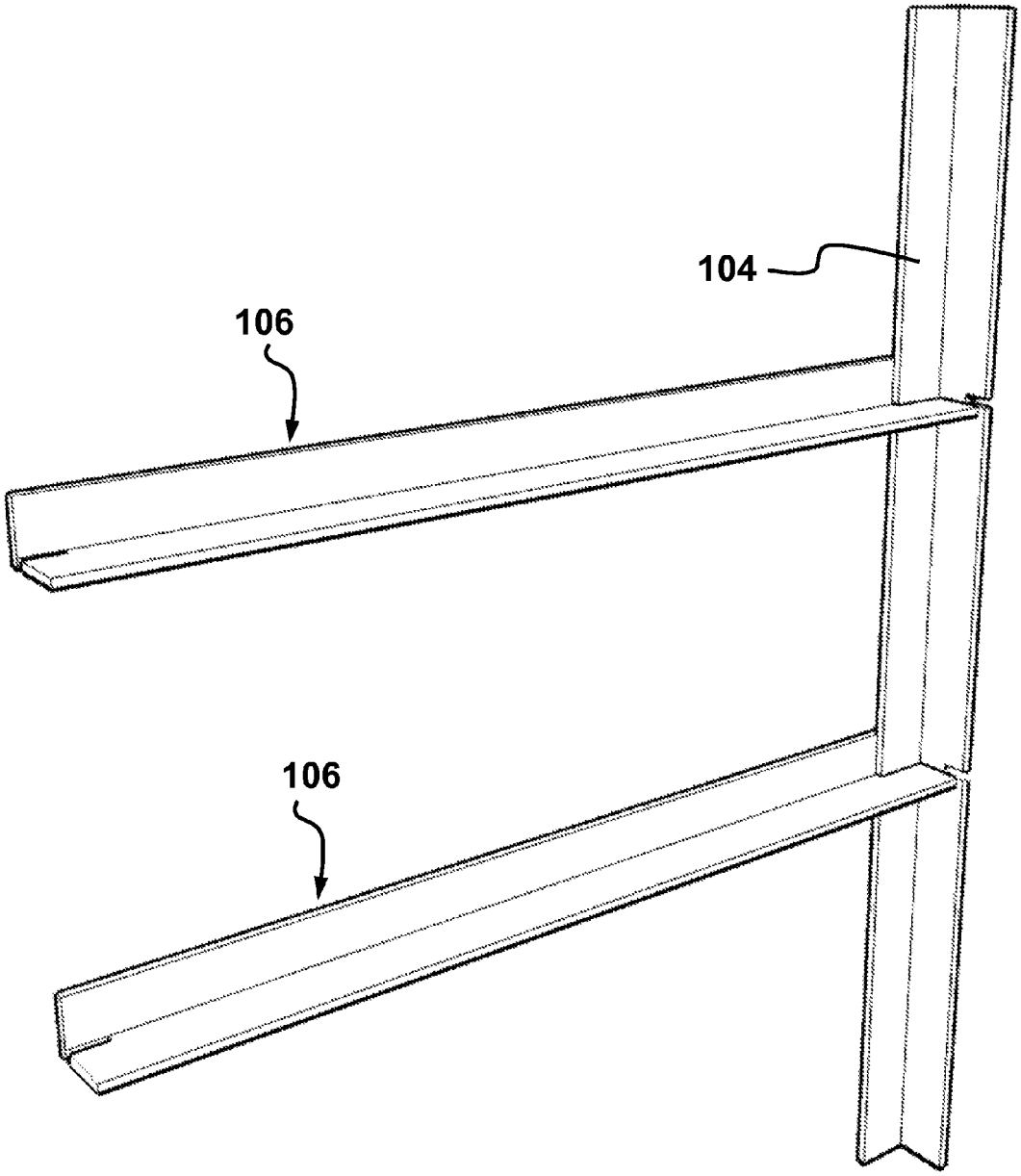
FIG. 5 is an isometric view of the parts shown in FIG. 4 once connected together.

FIG. 5 is an isometric view of the parts shown in FIG. 4 once connected together. As can be seen, each corner post strip 120 is insertable within the horizontally-projecting side rail strip 112 of the side rails 106 and the inner side of the corresponding vertically-projecting strips 110 is in direct contact with the outer side of the corner post strip 120. The width of the first through slots 116 corresponds approximately to the thickness of the corner post strip 120 and the width of the second through slots 126 corresponds approximately to the thickness of the horizontally-projecting side rail strip 112 of the side rails 106. This provides a tight fit between the peripheral surfaces of the through slots 116, 126 and the surfaces with which they co-engage. The friction holds the parts together, thereby giving the shelving system 100 strength and rigidity.

Figure 6:
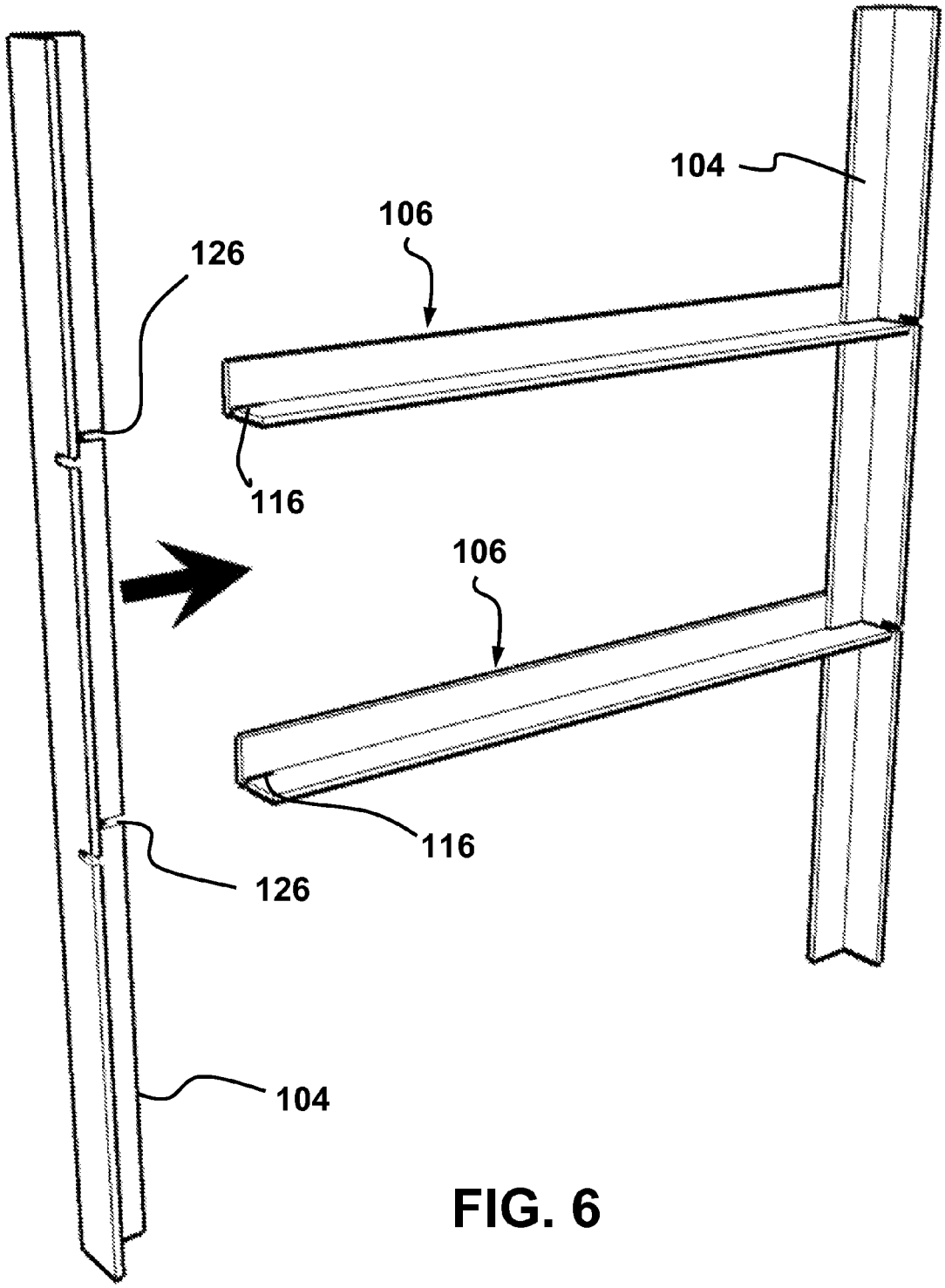
FIG. 6 is an isometric view illustrating the connection of the parts shown in FIG. 5 with another one of the corner posts being provided at the opposite ends of the side rails.

FIG. 6 is an isometric view illustrating the connection of the parts shown in FIG. 5 with another one of the corner posts 104 being provided at the opposite ends of the side rails 106.

Figure 7:
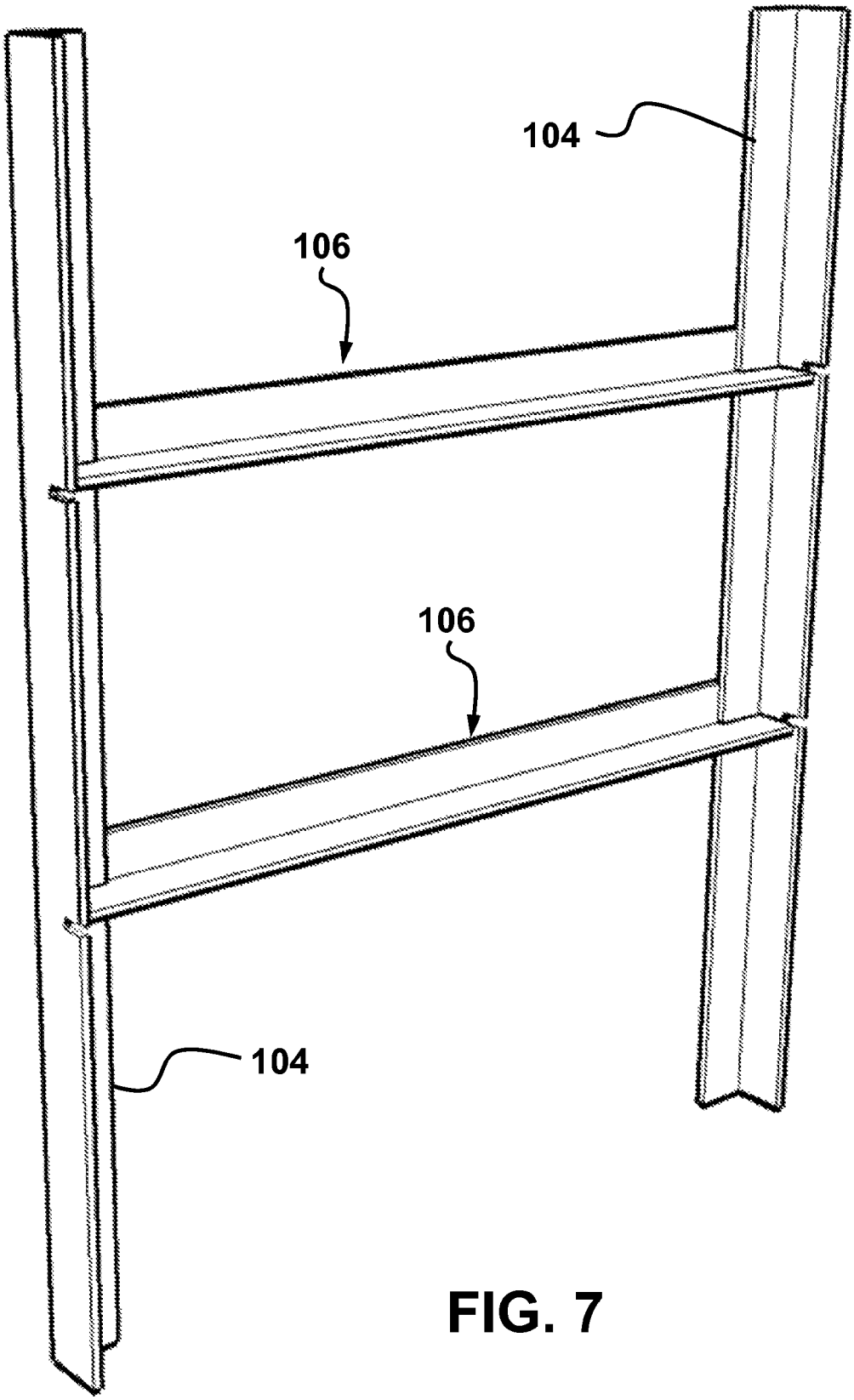
FIG. 7 is an isometric view of the parts shown in FIG. 6 once connected together.

FIG. 7 is an isometric view of the parts shown in FIG. 6 once connected together.

Figure 8:
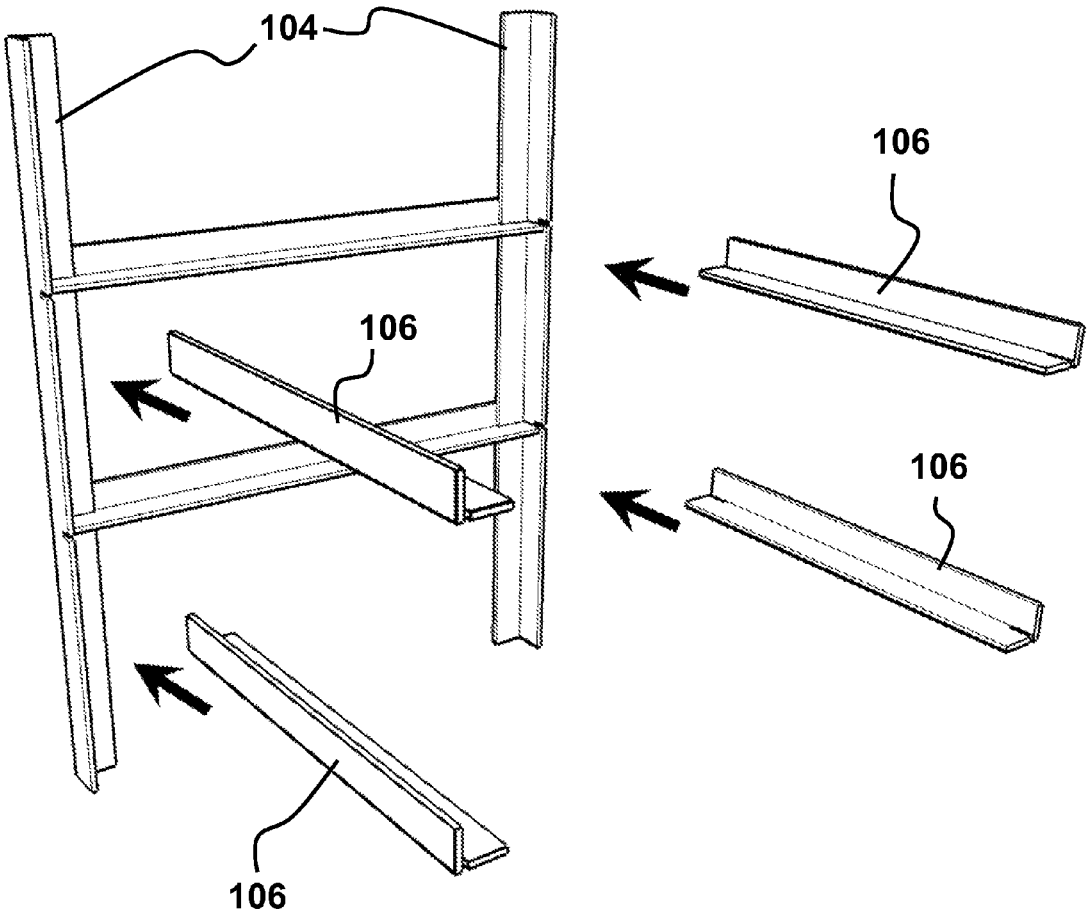
FIG. 8 is an isometric view illustrating the connection of the parts shown in FIG. 7 with additional ones of the side rails.

FIG. 8 is an isometric view illustrating the connection of the parts shown in FIG. 7 with additional ones of the side rails 106.

Figure 9:
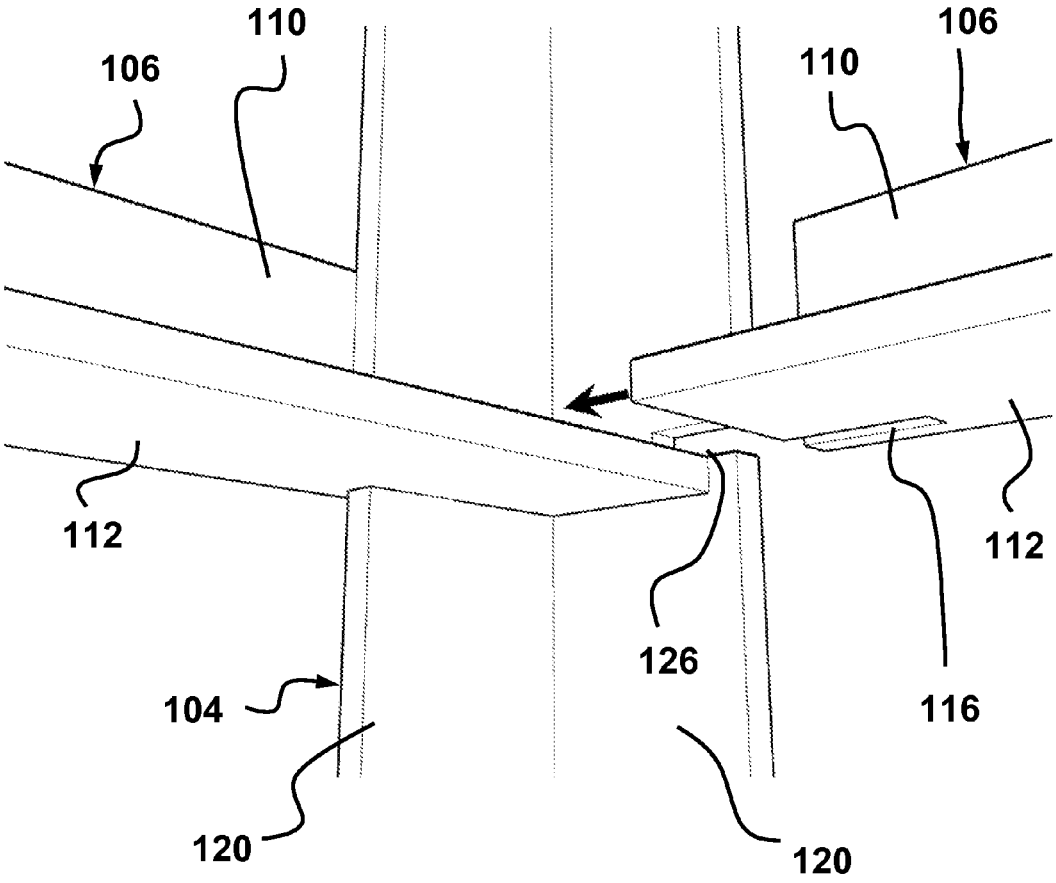
FIG. 9 is an enlarged isometric view illustrating the connection of one of the additional side rails in FIG. 8 with one of the corner posts, as viewed from the inner side.

FIG. 9 is an enlarged isometric view illustrating the connection of one of the additional side rails 106 in FIG. 8 with one of the corner posts 104, as viewed from the inner side. The corner post 104 already has two side rails 106 on the other corner post strip 120. In this example, the second through slots 126 of each matching pair are positioned approximately at the same distance from the corner post ends but they are offset from one another. They are offset of a distance substantially corresponding to the thickness of the horizontally-projecting strip 120 of the side rails 106 to avoid obstruction. This provides clearance for the adjacent side rail 106 that is part of the same shelf assembly 102 when this adjacent side rail 106 is connected to the same corner post 104. As can be seen in FIG. 9, the top edge of the horizontally-projecting side rail strip 112 of the side rail 106 on the left side is about at the same height than the bottom edge of the second through slot 126 with which the side rail 106 at the right is about to be connected to. It should be noted that the actual offset can also be slightly less than the thickness of the horizontally-projecting side rail strip 112 of the side rails 106 to create an interfering engagement between the top edge surface of the side rail 106 at the left and the bottom edge surface of the side rail 106 at the right. This increases friction and the forces holding the parts together.

Figure 10:
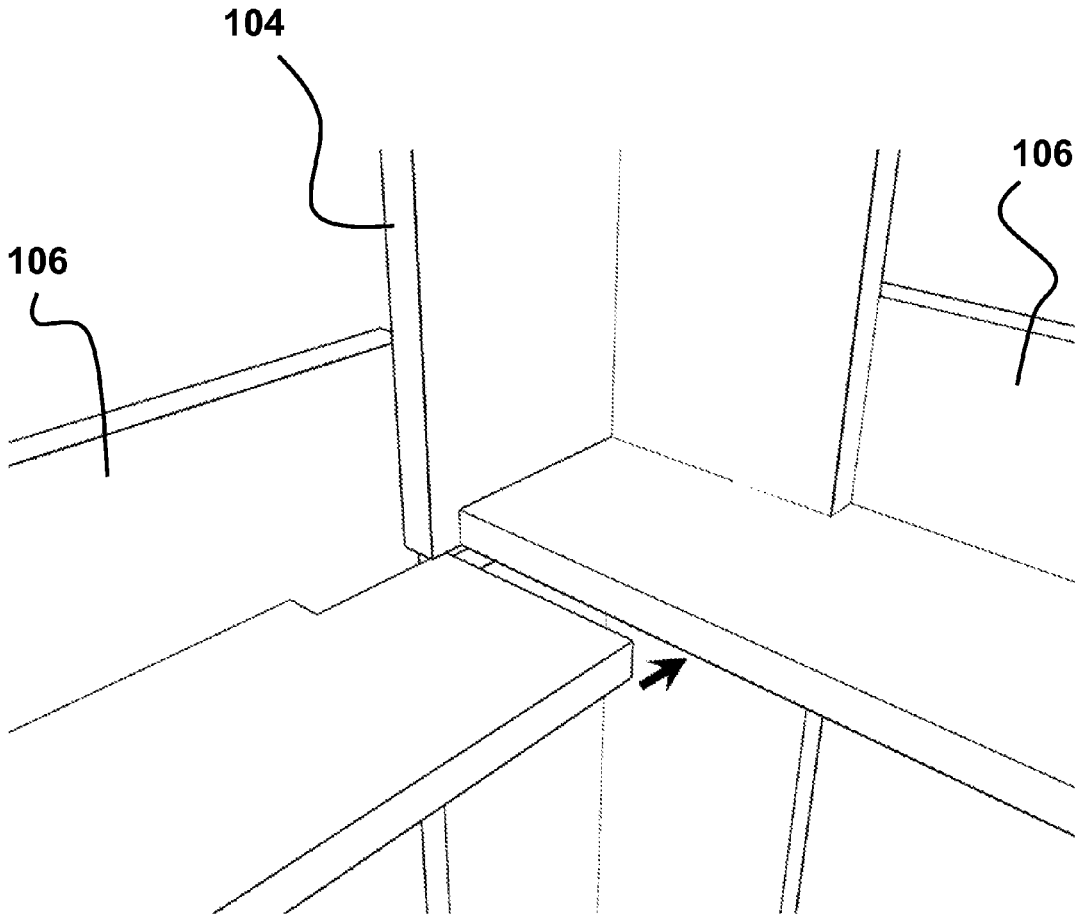
FIG. 10 is a view similar to FIG. 9 and illustrates the connection of another one of the additional side rails in FIG. 8 with another one of the corner posts, as viewed from the inner side.

FIG. 10 is a view similar to FIG. 9 and illustrates the connection of another one of the additional side rails 106 in FIG. 8 with another one of the corner posts 104, as viewed from the inner side. However, one of the side rails 106 in FIG. 10 is the same side rail 106 as the one used in FIG. 9. The corresponding side rail end is then at the top. Alternatively, one can design the shelving system 100 so that the side rails 106 will be truly horizontal in-between two corner posts 104. Still, one can design the shelving system 100 so that both options are available. If desired, the bottom edge surfaces and the top edge surfaces of the side rails 106 can be machined to facilitate the fit and decrease the offset between the positions of the matching second through slots 126.

Figure 11:
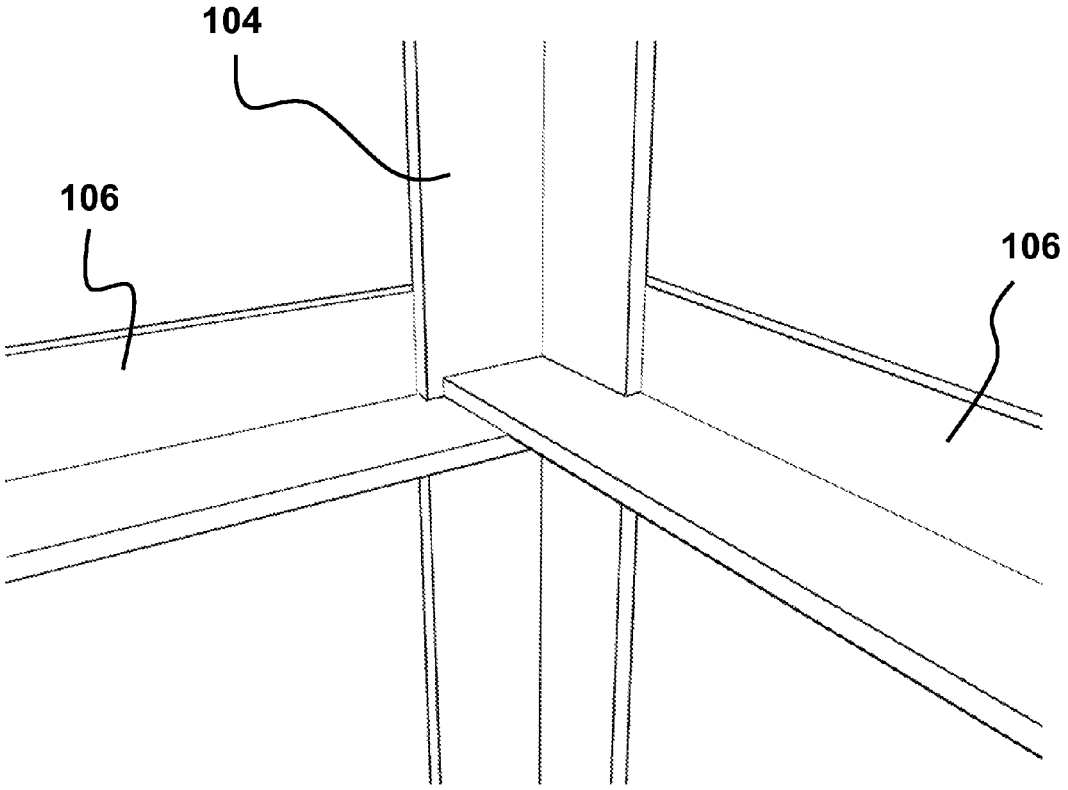
FIG. 11 is an isometric view of the parts shown in FIG. 10 once the additional side rail and the corner post are connected together.

FIG. 11 is an isometric view of the parts shown in FIG. 10 once the additional side rail 106 and the corner post 104 are connected together. As can be seen, the ends are overlapping. This overlapping creates a load-bearing engagement of one of the side rails 106 to the other.

Figure 12:
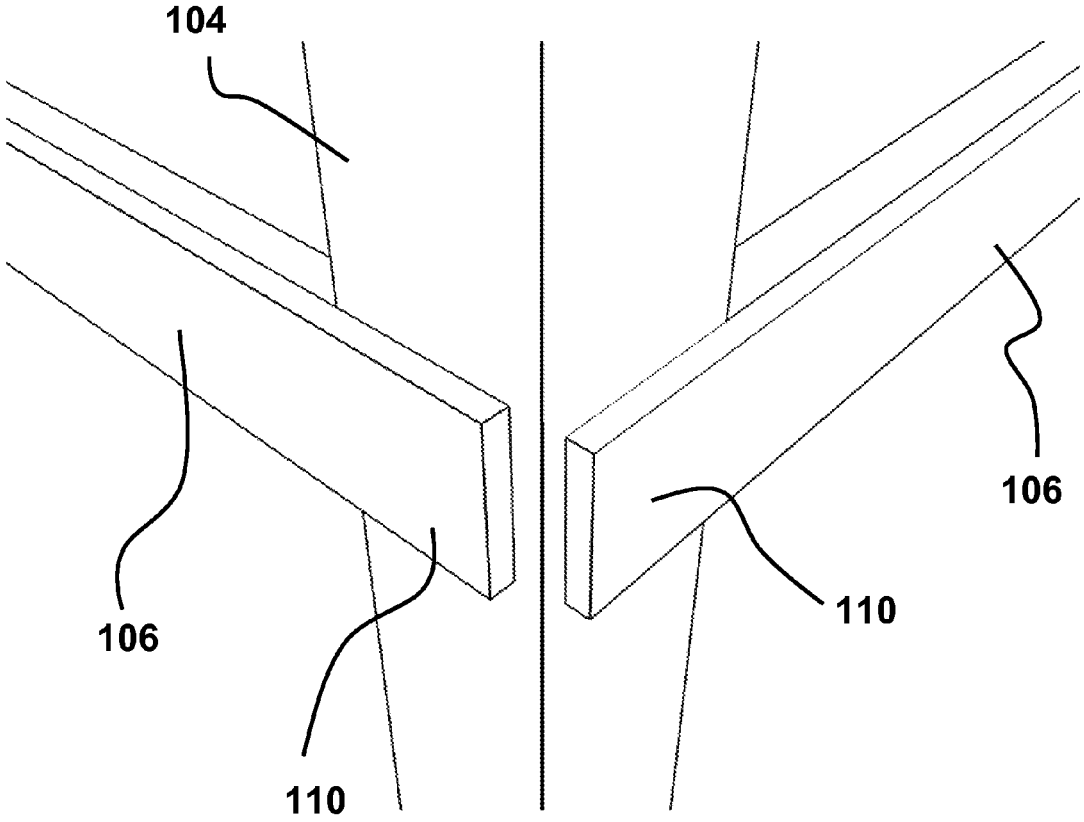
FIG. 12 is a view similar to FIG. 11 but from the outer side.

FIG. 12 is a view similar to FIG. 11 but from the outer side. As can be seen, the tip of the two adjacent vertically-projecting side rail strips 110 are spaced apart from one another since the tips of the corresponding horizontally-projecting side rail strips 112 abut on the inner side of the corner post 104. Alternatively, one can have the vertically-projecting side rail strips 110 longer than the horizontally-projecting side rail strips 112. Other variants are possible as well.

Figure 13:
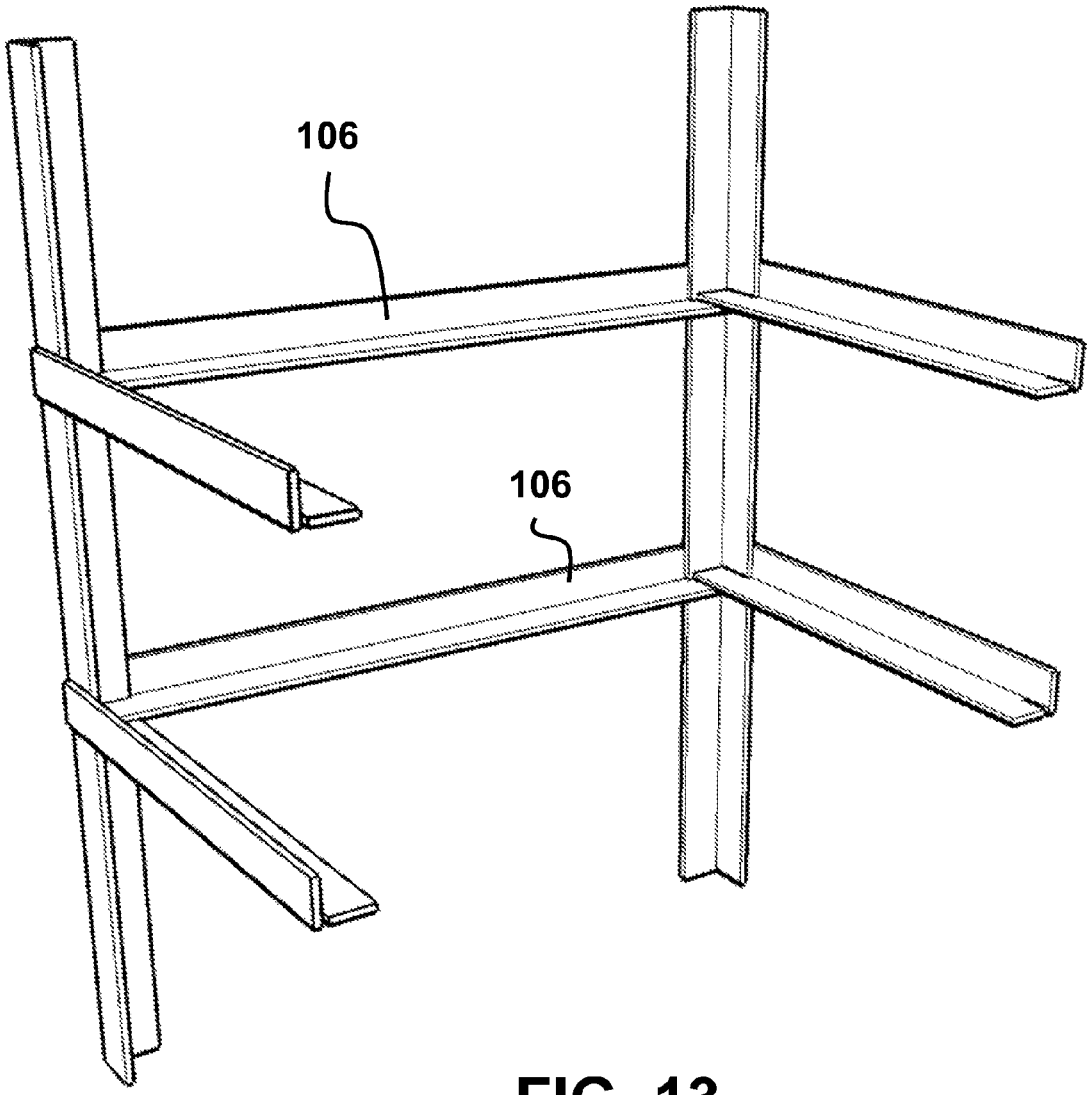
FIG. 13 is an isometric view of the parts shown in FIG. 8 once connected together.

FIG. 13 is an isometric view of the parts shown in FIG. 8 once connected together.

Figure 14:
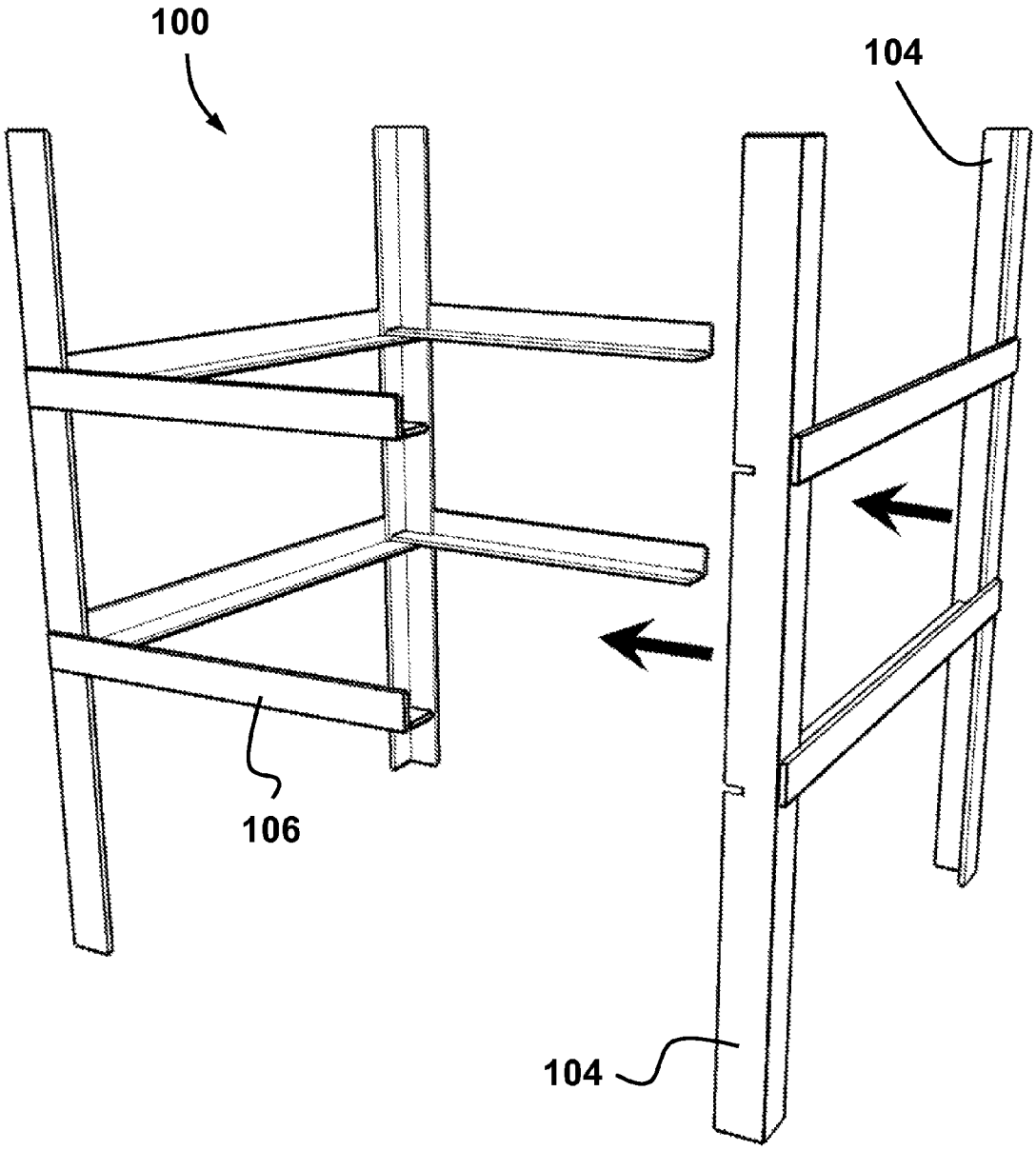
FIG. 14 is an isometric view illustrating the connection of the parts shown in FIG. 13 with other side rails and corner posts to form the shelving system of FIG. 1.

FIG. 14 is an isometric view illustrating the connection of the parts shown in FIG. 13 with other side rails 106 and corner posts 104 to form the shelving system 100 of FIG. 1.

Figure 15:
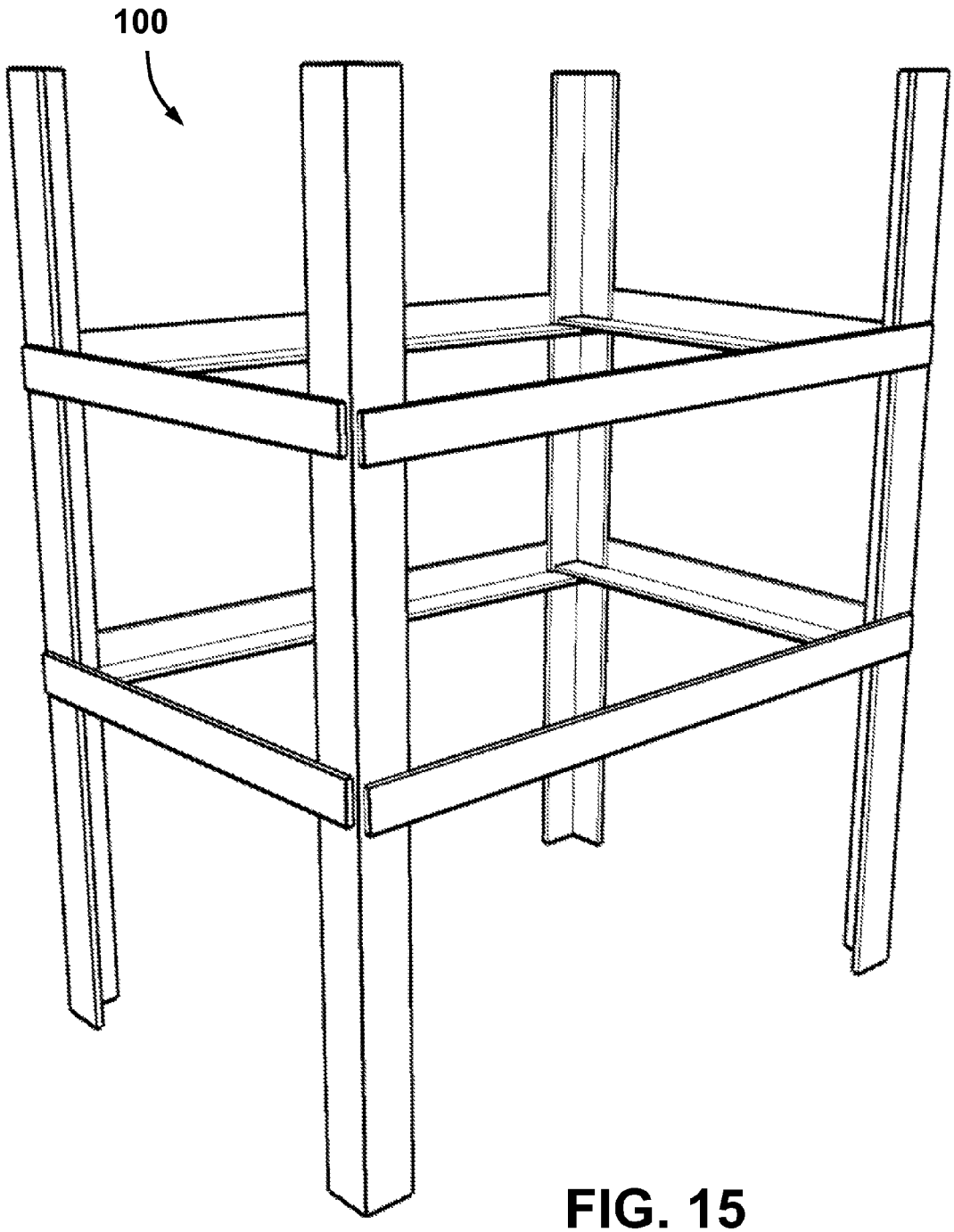
FIG. 15 is an isometric view of the parts shown in FIG. 14 once connected together.

FIG. 15 is an isometric view of the parts shown in FIG. 14 once connected together. These interlocked parts form a self-standing skeletal structure.

Figure 16:
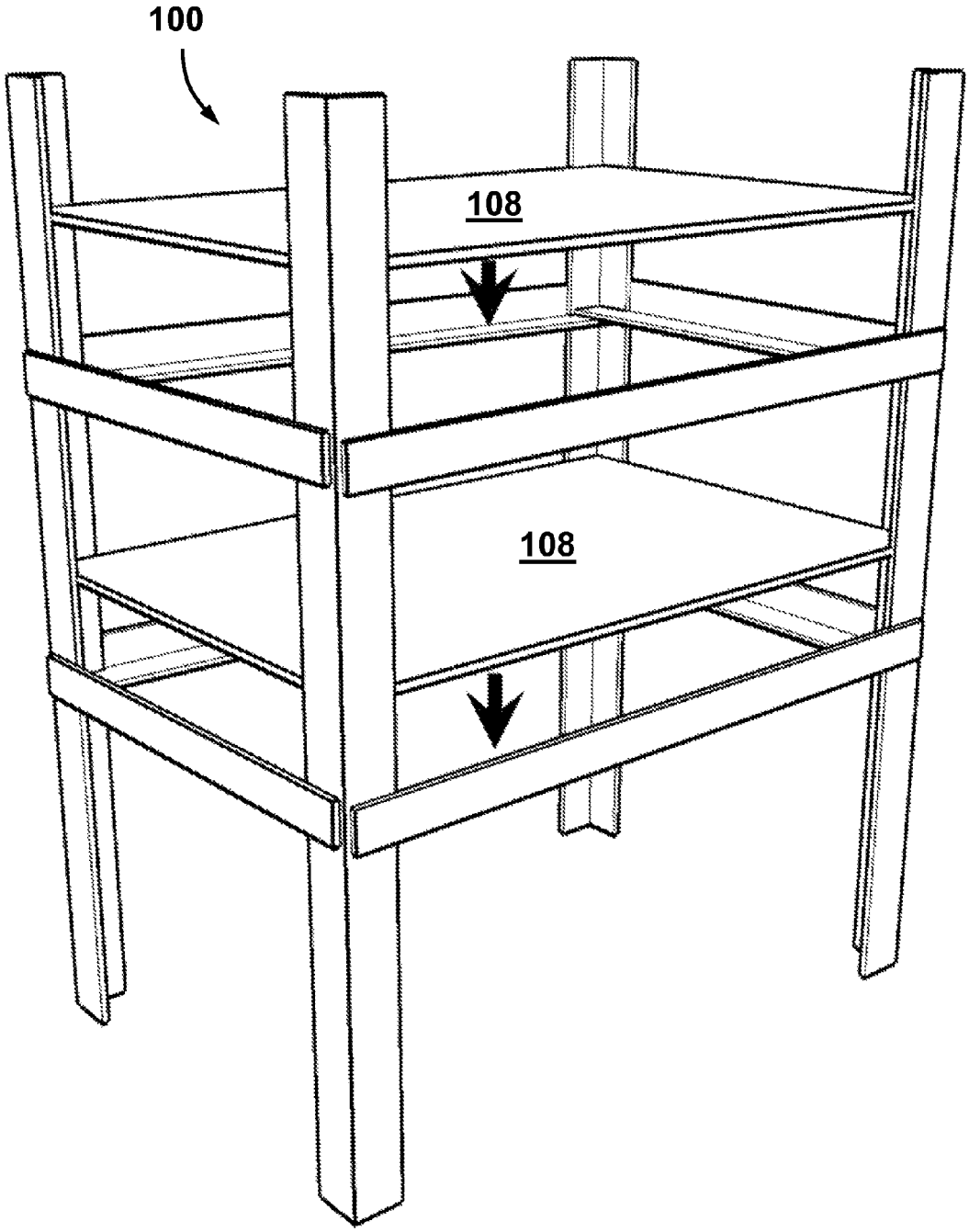
FIG. 16 is an isometric view illustrating boards being installed over a corresponding one of the shelf assemblies on the shelving system of FIG. 15.

FIG. 16 is an isometric view illustrating boards 108 being installed over a corresponding one of the shelf assemblies 102 on the shelving system of FIG. 15. Each board 108 is cut for a tight fit between the inner sides of the corner posts 104 so as to form a tray. The side edges underneath the boards 108 rest by gravity on the inner top surface of the corresponding side rails 106.

Figure 17:
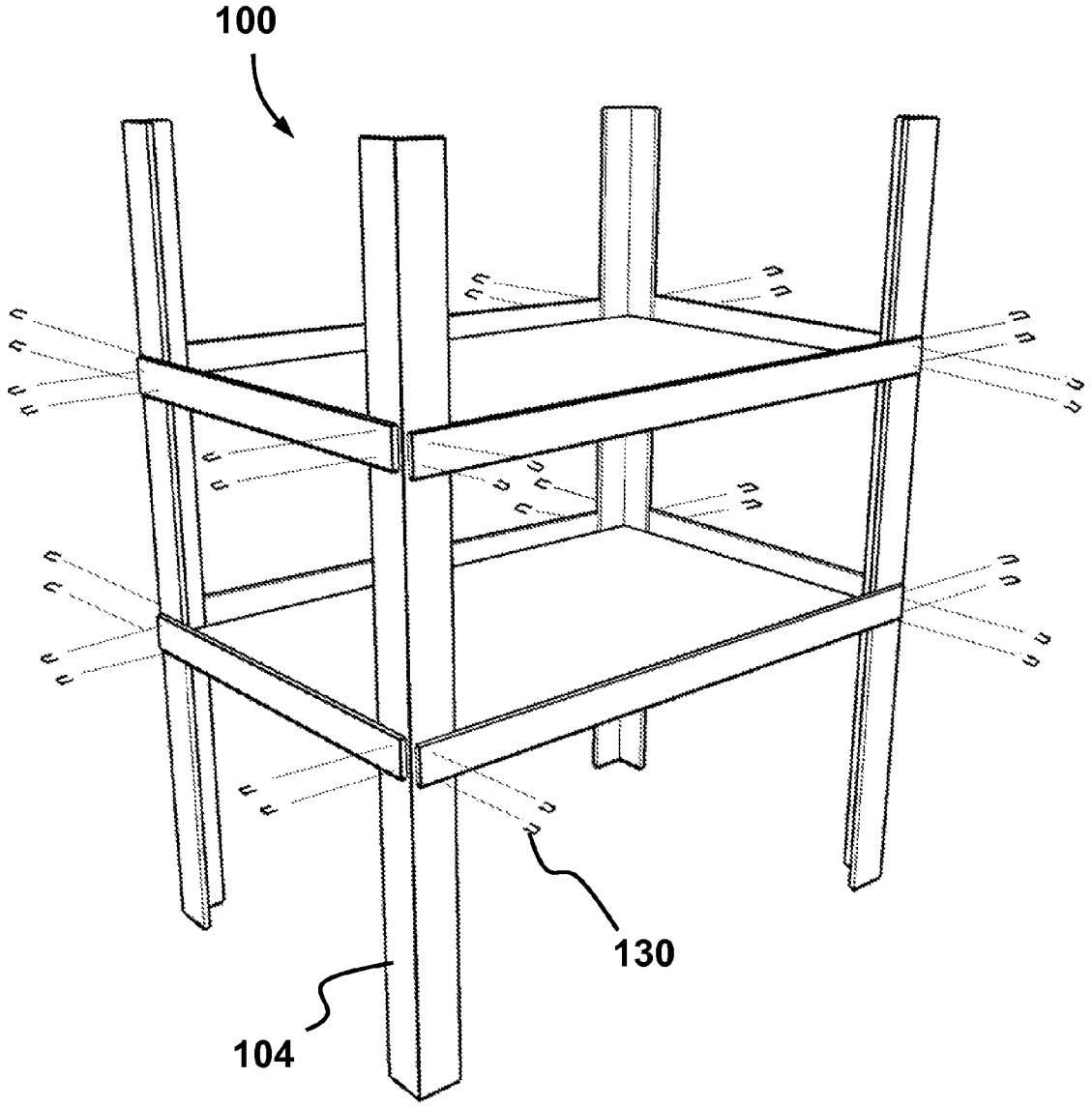
FIG. 17 is an isometric view illustrating an example of how the side rails and the corner posts can be rigidly secured together.

FIG. 17 is an isometric view illustrating an example of how the side rails 106 and the corner posts 104 can be rigidly secured together. As can be seen, metallic staples 130 are used in this example. The vertically-projecting side rail strips 110 are secured to the corresponding corner post strips 120 using two staples 130. Using a different number of staples 130, i.e. one or more than two per junction, is also possible. The staples 130 are installed after the installation of the boards 108. This way, an assembly worker can do fine adjustments before stapling the parts. Variants are possible as well.

It should be noted that depending on the implementation and the materials used for the various parts, the side rails 106 and the corner posts 104 can be rigidly secured using other suitable mechanical fasteners or methods to add strength and rigidity. They can also be secured using staples 130 together with one or more other fasteners or methods, or be secured using a combination of other fasteners or methods. Examples of these other fasteners or methods include, depending on the material and to name just a few: nails, screws, bolts, dowels, glue, welding, brazing, riveting, outer strapping, push pins, etc.

The shelving system 100 can be used alone, for instance with the bottom ends of the corner posts 104 resting directly on the floor surface, or be used for instance with a pallet positioned at the bottom thereof. When used with a pallet, the bottom ends of the corner posts 104 can rest directly on the floor surface or not. The pallet is useful for handling the shelving system 100 with a forklift or the like.

Figure 18:
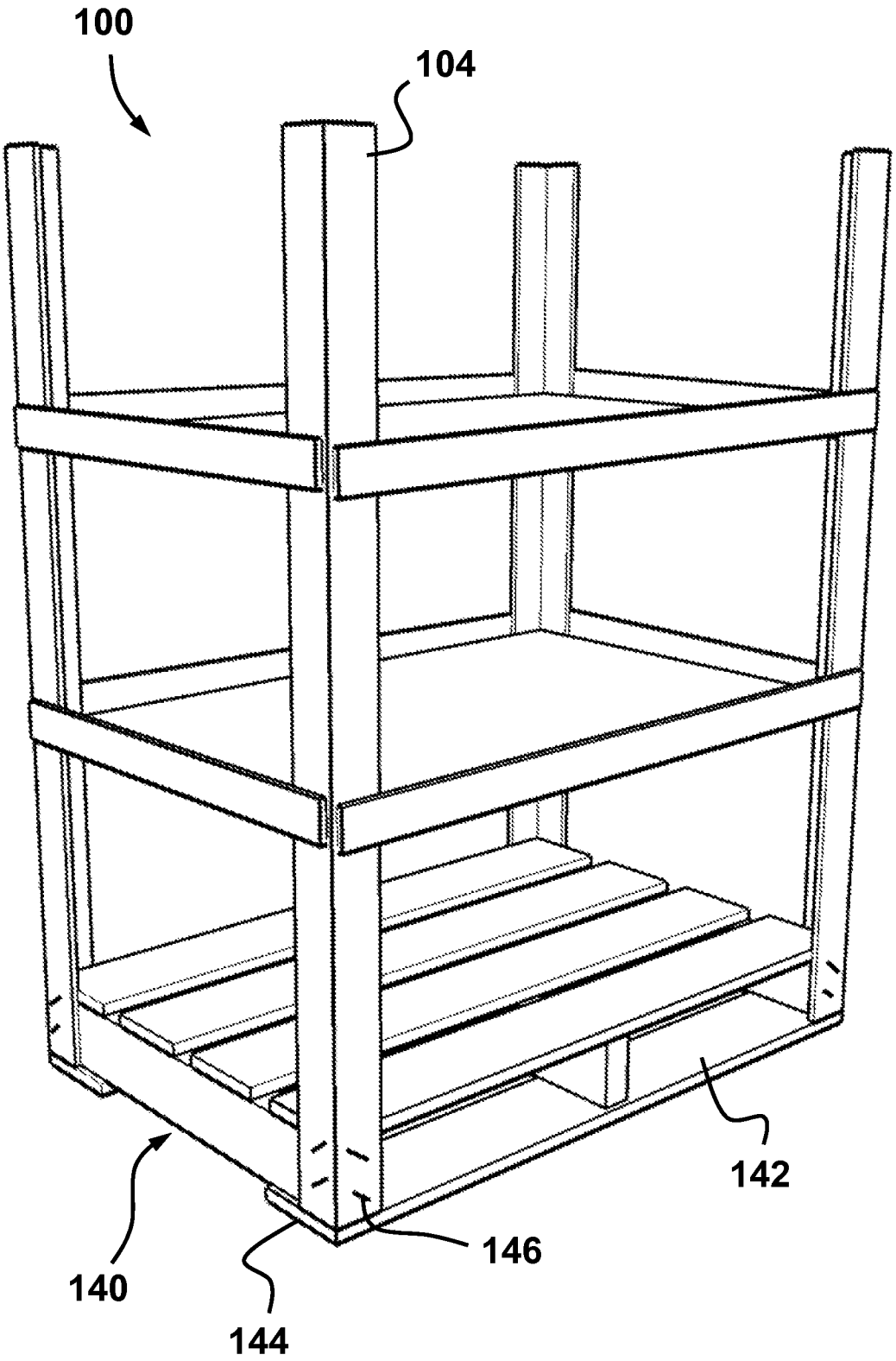
FIG. 18 is an isometric view of the shelving system of FIG. 1 being rigidly attached over an example of a pallet.

FIG. 18 is an isometric view of the shelving system 100 of FIG. 1 being rigidly attached over an example of a pallet 140. This pallet 140 can be made for instance of wood. As can be seen, the pallet 140 is constructed with the bottom planks 142 being slightly outwardly offset from the rest of the pallet 140 to create a series of outwardly-projecting ledges 144 on which the bottom ends of the corner posts 104 can rest. In use, at least some of the weight from the shelving system 100 can be transmitted to the pallet 140 through the upper side of these ledges 144.

The bottom section of the corner posts 104 are also stapled directly to the pallet 140 in the illustrated example, thereby rigidly securing the shelving system 100 and the pallet 140 together. The corner posts 104 and the pallet 140 can be rigidly secured together using other suitable fasteners or methods, for instance those already named above. In FIG. 18, the fasteners are staples 146 that are inserted directly through the bottom ends of the corner posts 104 and into the pallet 140. Variants are possible as well. For instance, one can use other kinds of fasteners.

Figure 19:
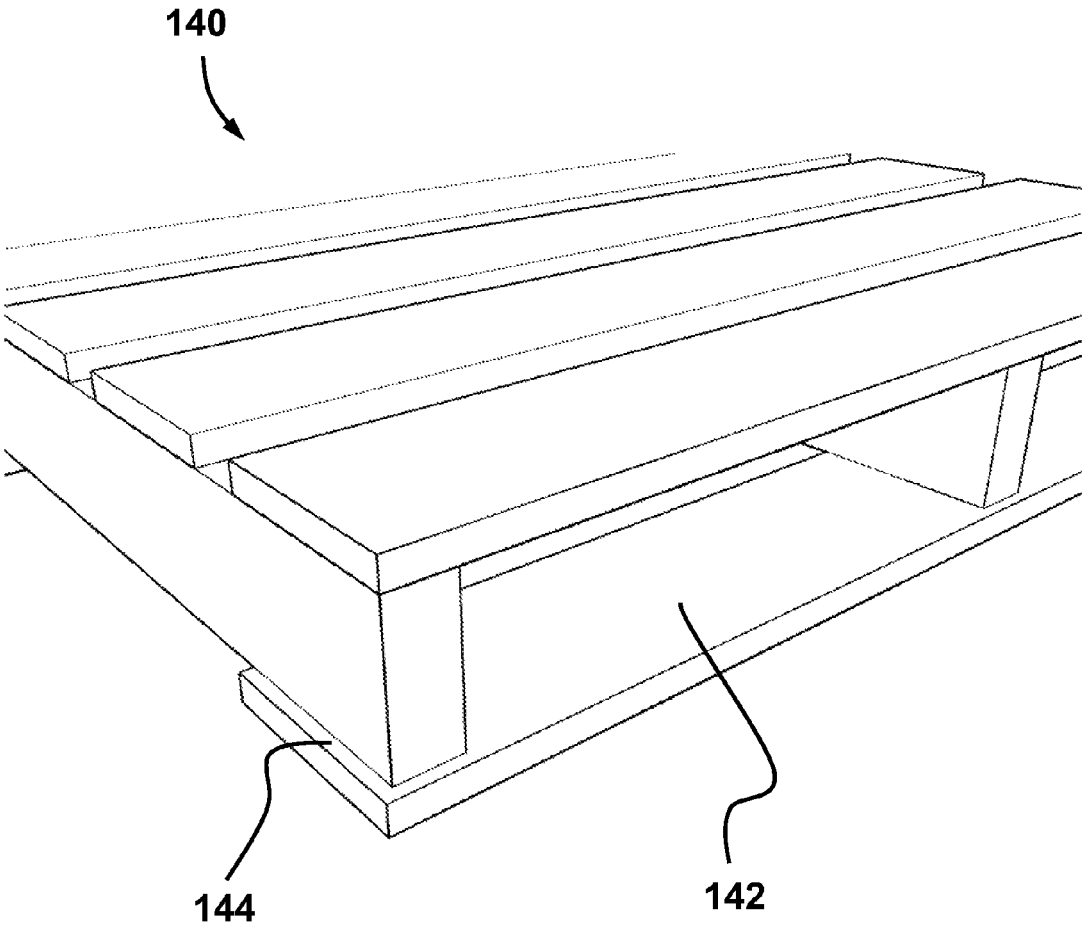
FIG. 19 is an enlarged isometric view of the pallet shown in FIG. 18.

FIG. 19 is an enlarged isometric view of the pallet 140 shown in FIG. 18.

Figure 20:
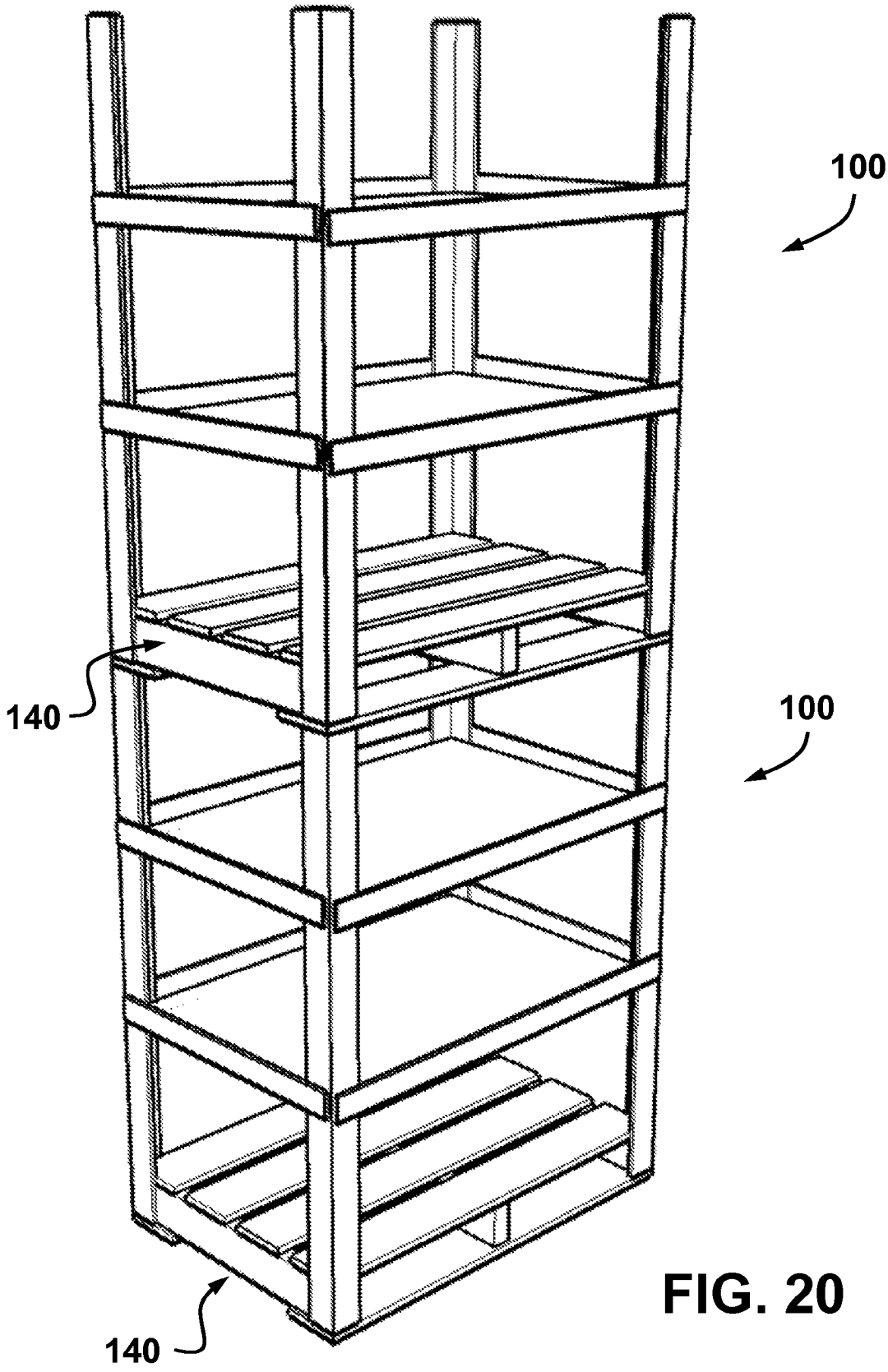
FIG. 20 is an isometric view of an example of implementation where two shelving systems and their corresponding pallets as shown in FIG. 18 are stacked.
Figure 21:
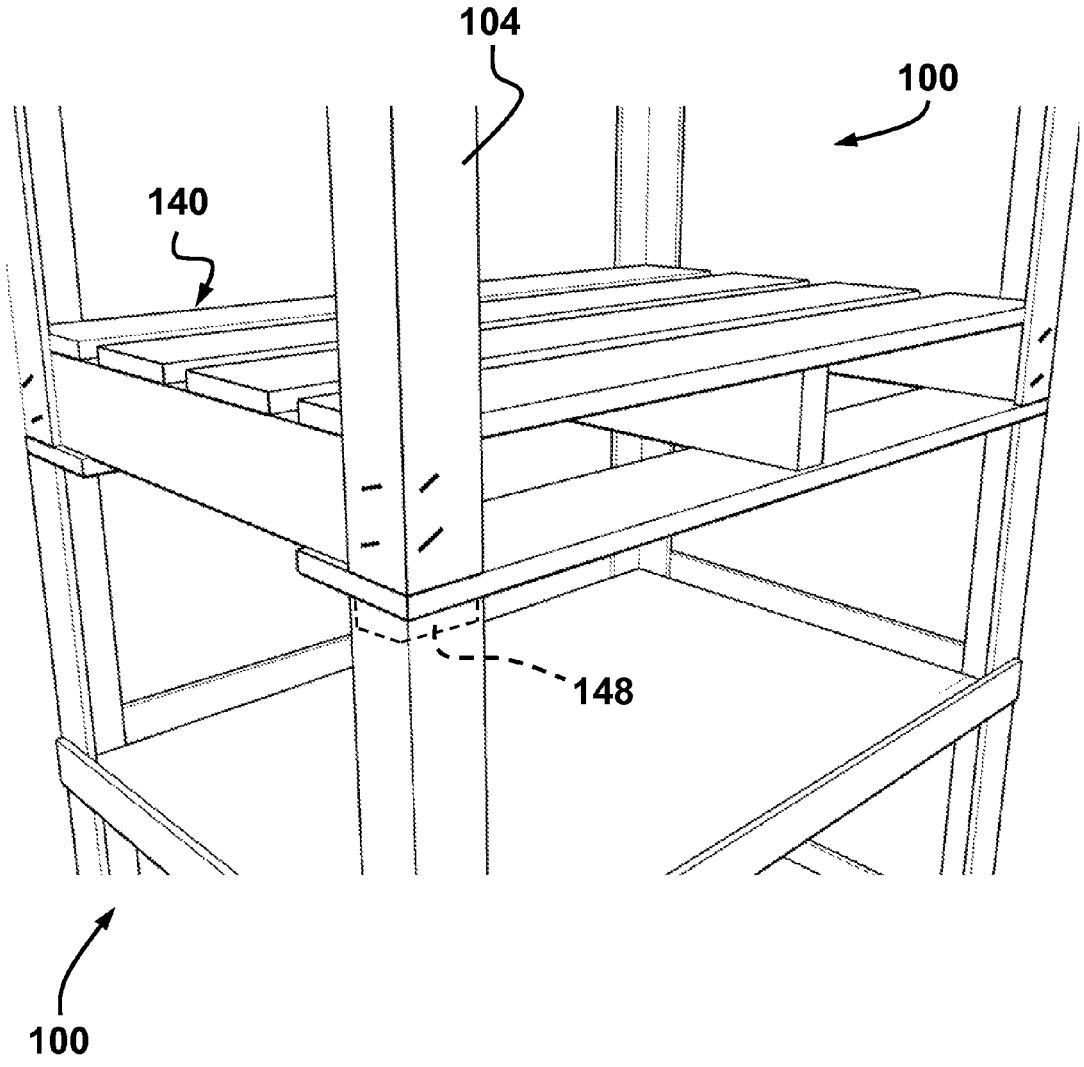
FIG. 21 is an enlarged view of the junction between the two shelving systems shown in FIG. 20.

FIG. 20 is an isometric view of an example of implementation where two shelving systems 100 and their corresponding pallets 140 as shown in FIG. 18 are stacked, such as for storage, transportation and/or display. FIG. 21 is an enlarged view of the junction between the two shelving systems 100 shown in FIG. 20. As can be seen, the upper pallet 140 includes four alignment corner blocks 148 (one being shown schematically in FIG. 21) on the underside, the corner blocks 148 being attached under the ledges 144. The corner blocks 148 are configured and disposed to fit on the top inner side of the corner posts 104, thereby facilitating the alignment and preventing the top shelving system 100 from moving sideways. As shown in FIG. 21, the top ends of the corner posts 104 of the bottom shelving system 100 will engage the bottom surface of the ledges 144 of the pallet 140 to which the top shelving system 100 is attached. Positioning the shelving systems 100 over one another optimizes the storage floor space.

Figure 22:
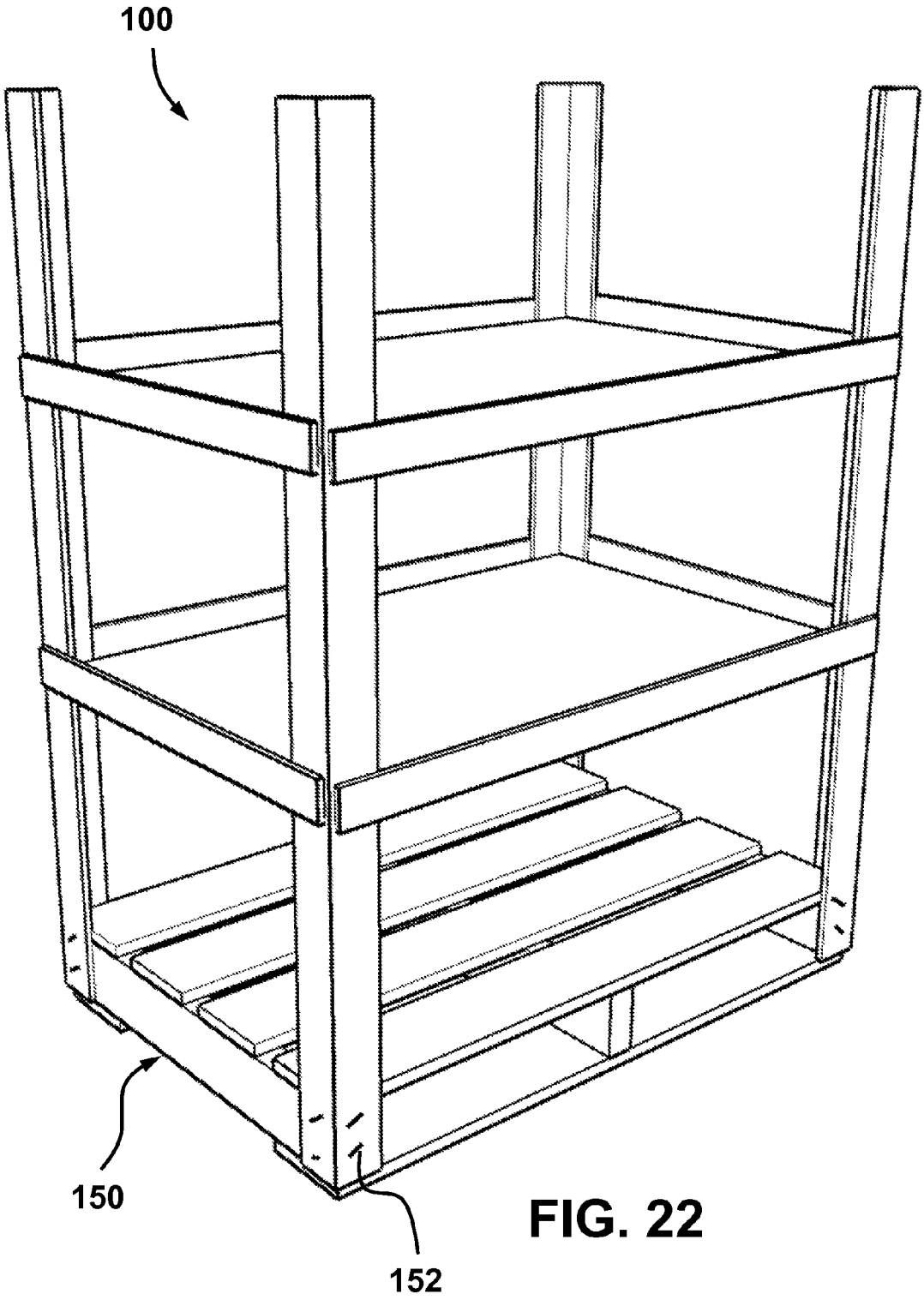
FIG. 22 is a view similar to FIG. 18 but illustrates the shelving system being rigidly attached over another example of a pallet.
Figure 23:
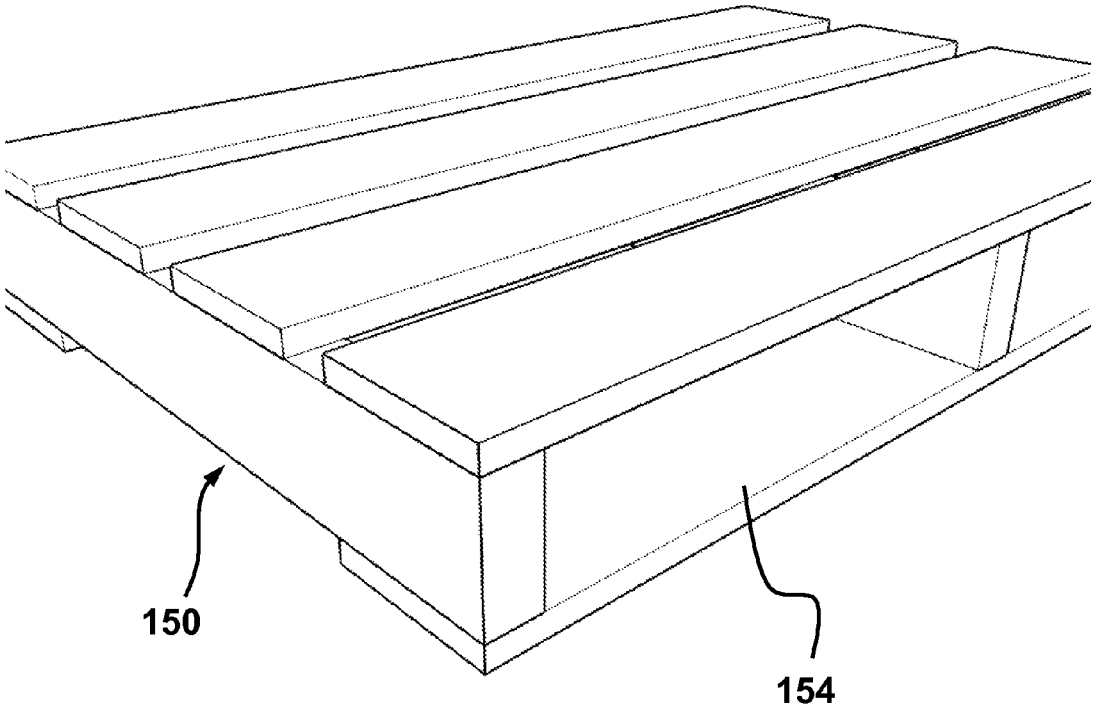
FIG. 23 is an enlarged isometric view of the pallet shown in FIG. 22.

FIG. 22 is a view similar to FIG. 18 but illustrates the shelving system 100 being rigidly attached over another example of a pallet, i.e. a standard pallet 150. This pallet 150 has no ledges. FIG. 23 is an enlarged isometric view of the pallet 150 shown in FIG. 22. The corner posts 104 and the pallet 150 can be rigidly secured together using other suitable fasteners or methods. In FIG. 22, the fasteners are staples 152 that are inserted directly through the bottom ends of the corner posts 104 and into the pallet 150. Variants are possible as well. For instance, one can use other kinds of fasteners. FIG. 23 shown that the illustrated pallet 150 includes bottom planks 154.

Figure 24:
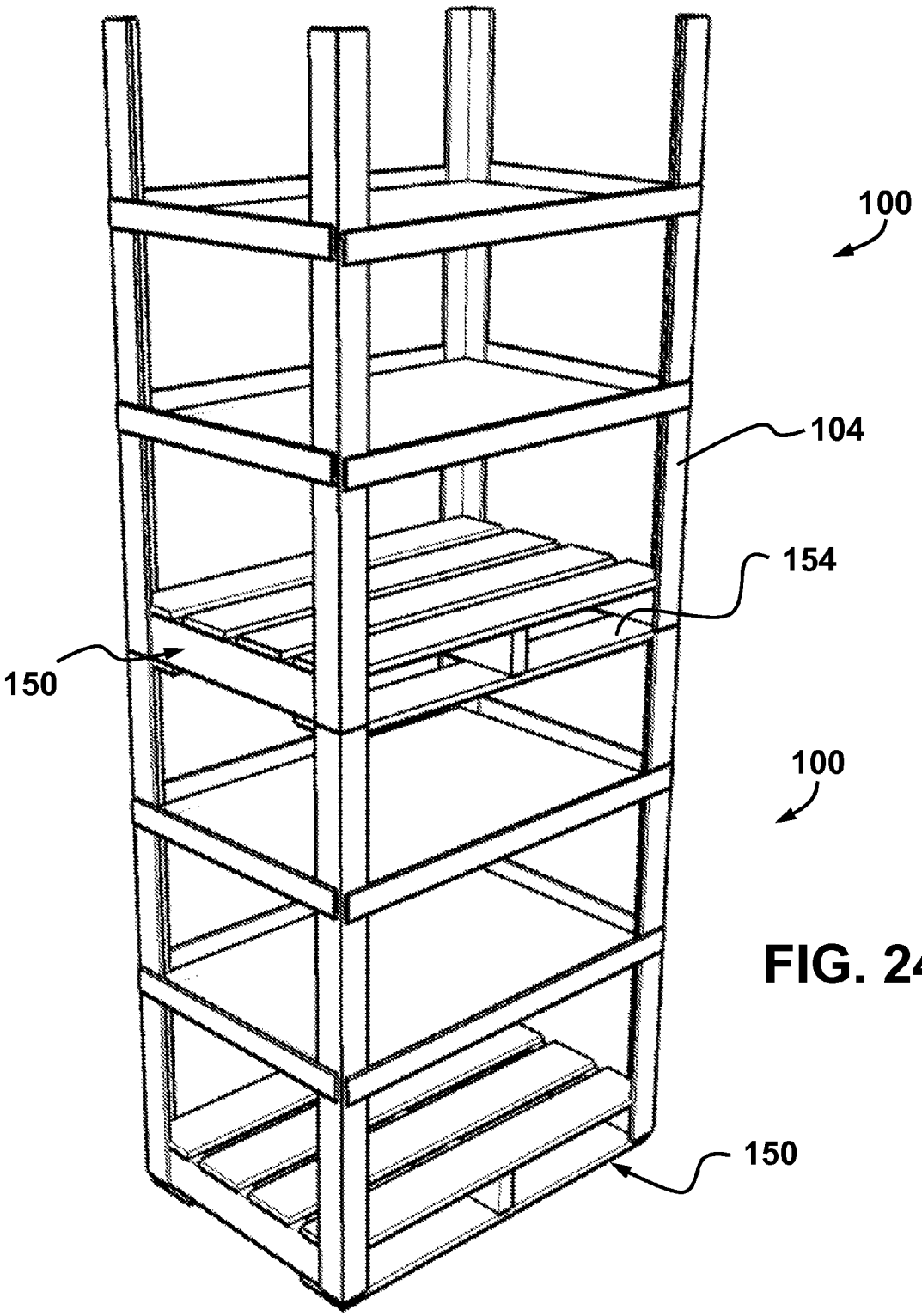
FIG. 24 is a view similar to FIG. 20, showing two shelving systems and their corresponding pallets as shown in FIG. 22 being stacked.
Figure 25:
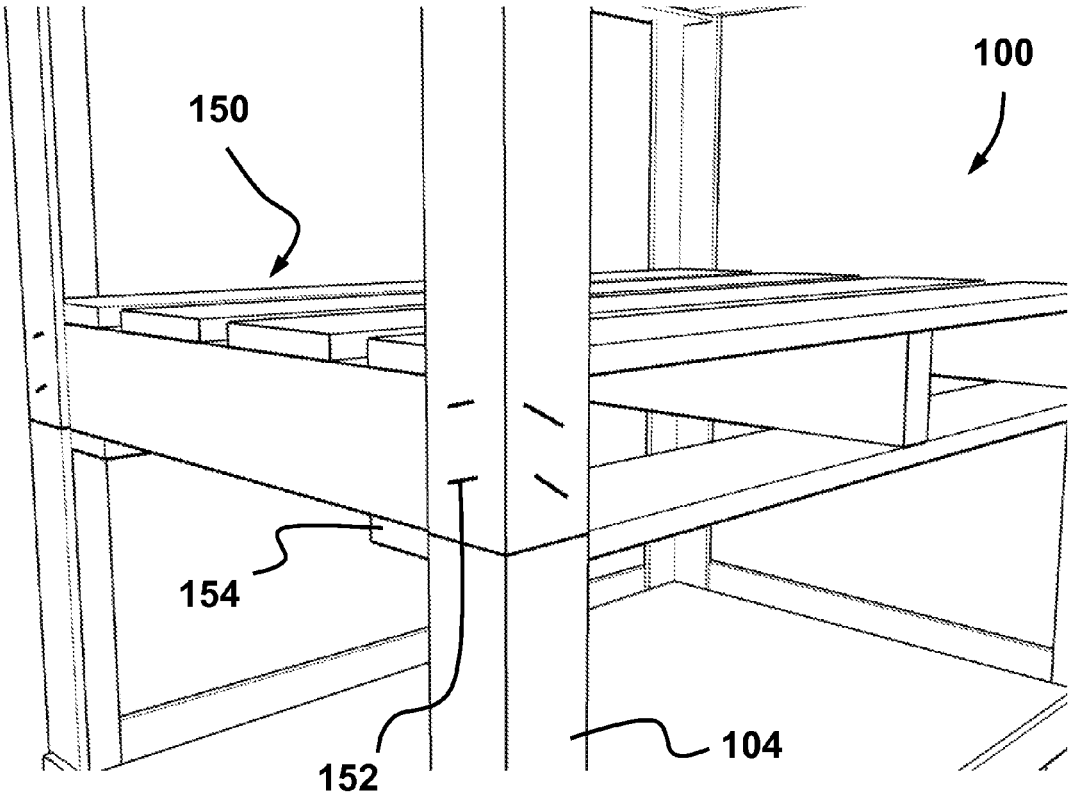
FIG. 25 is an enlarged view of the junction between the two shelving systems shown in FIG. 24.

FIG. 24 is a view similar to FIG. 20, showing another example of an implementation where two shelving systems 100 as shown in FIG. 22 are stacked over one another. FIG. 25 is an enlarged view of the junction between the two shelving systems 100 shown in FIG. 24. As can be seen, a vertical space was left between the bottom end of the corner posts 104 and the floor. This space corresponds approximately to the thickness of the bottom planks 154 of the pallet 150. This way, the bottom ends of the corner posts 104 of the top shelving system 100 rest directly on the top end of the corresponding corner posts 104 of the bottom shelving system 100 and the bottom planks 154 of the pallet 150 to which the top shelving system 100 is attach prevent it from moving sideways. More than two shelving systems 100 can be stacked over one another, depending on the implementation.

Figure 26:
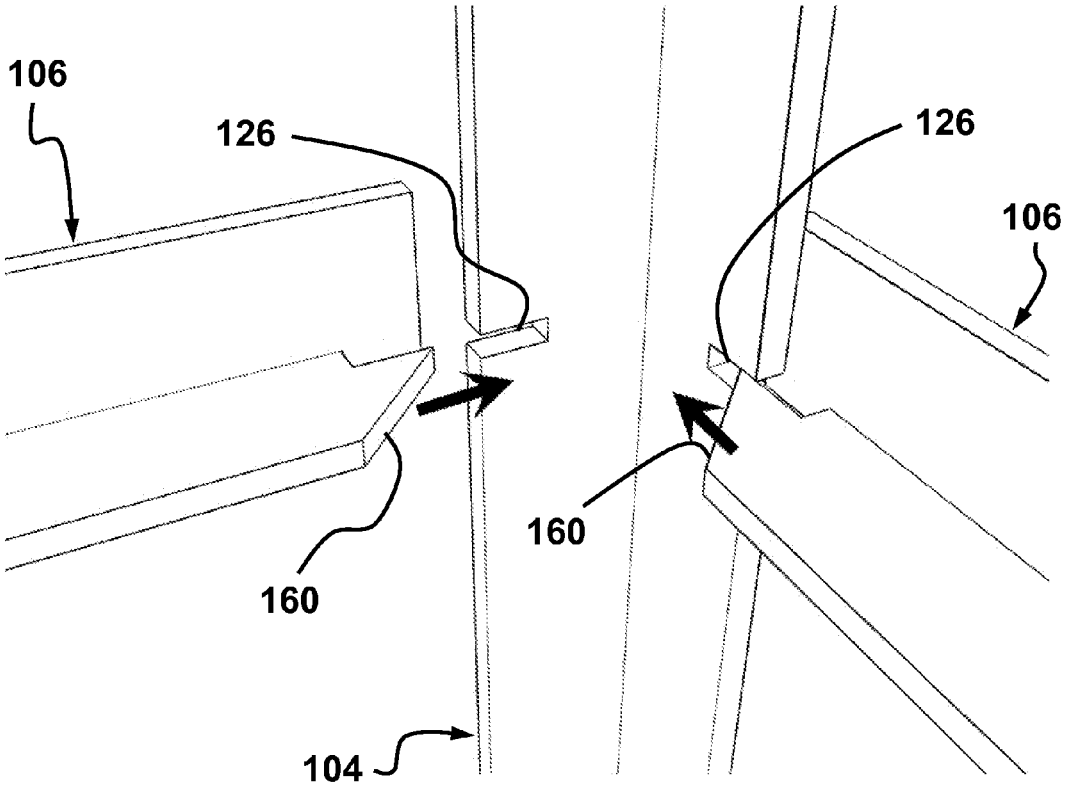
FIG. 26 is an enlarged isometric view illustrating another example of a connection of two side rails with a corner post, as viewed from the inner side.
Figure 27:
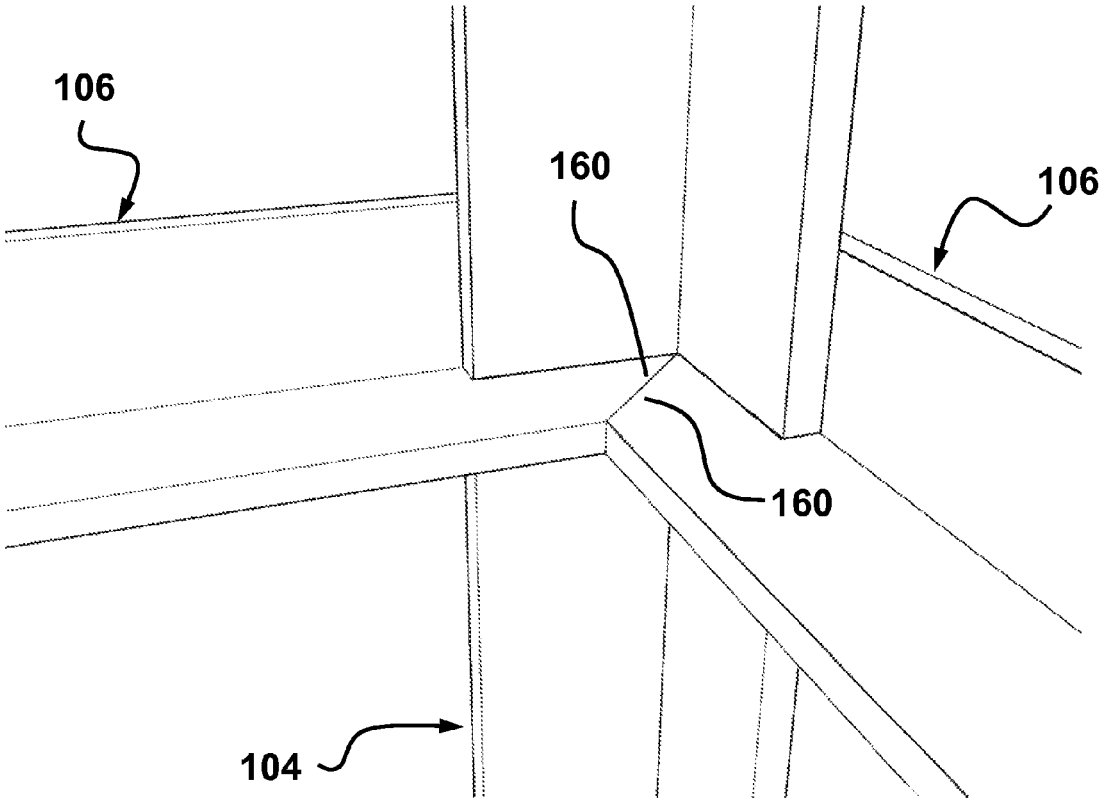
FIG. 27 is an isometric view of the parts shown in FIG. 26 once connected together.

FIG. 26 is an enlarged isometric view illustrating another example of a connection of side rails 106 with a corner post 104. FIG. 27 is an isometric view of the parts shown in FIG. 26 once connected together. In this example, the matching second through slots 126 of the corner post 104 are in registry with one another (i.e. are not vertically offset) and the inner edge of the horizontally-projecting side rail strips 112 at the ends of the side rails 106 are beveled. These beveled tips 160 have complementary angles. The illustrated example shows that they are each beveled at 45 degrees. Variants are possible as well. As shown in FIG. 27, the top surface of the horizontally-projecting side rail strips 112 of the side rails 106 will form an uninterrupted leveled rim once this shelving system 100 will be fully assembled. This arrangement can be useful for smaller and lightweight implementations.

Figure 28:
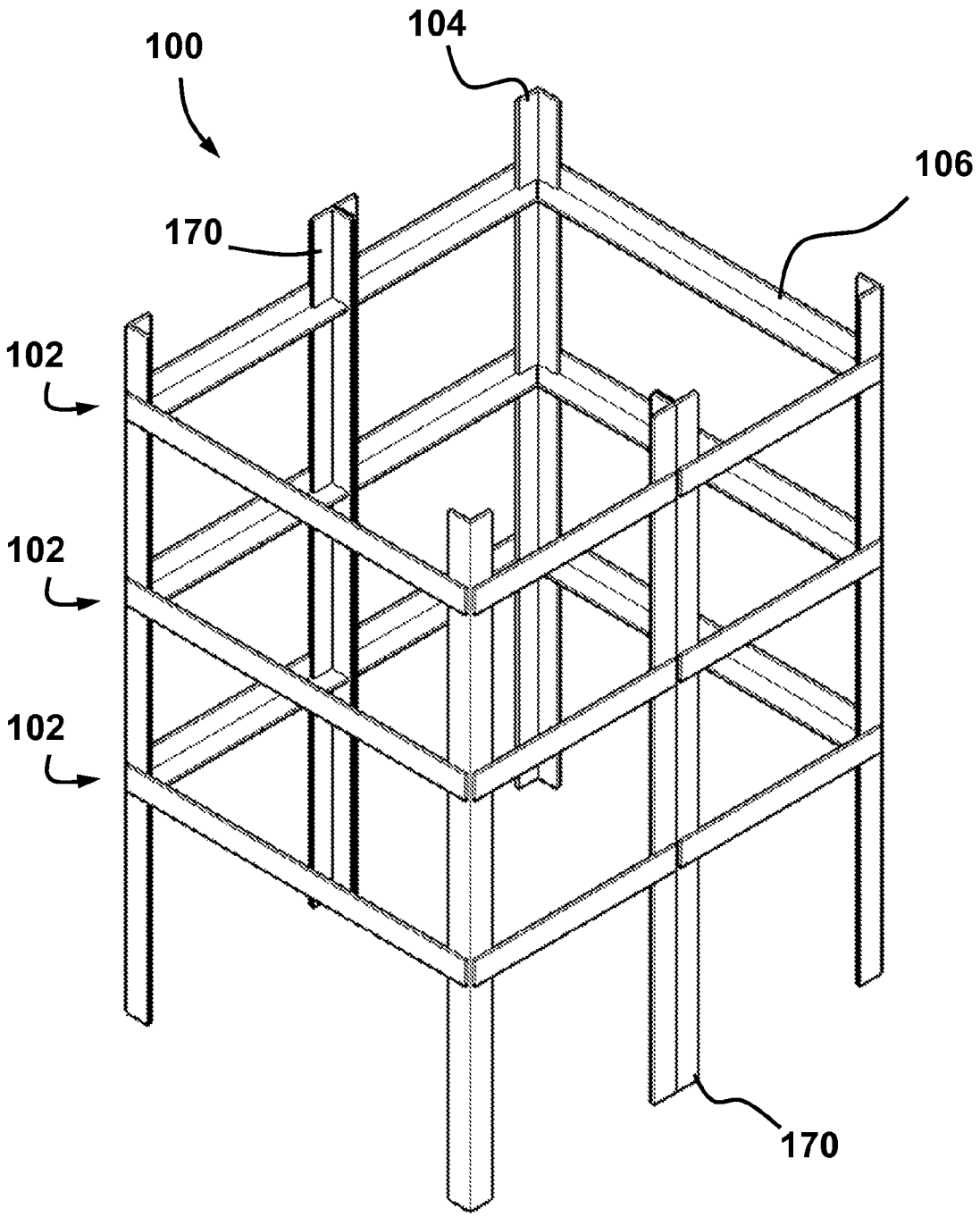
FIG. 28 is an isometric view illustrating another example of a modular shelving system incorporating the proposed concept.

FIG. 28 is an isometric view illustrating another example of a modular shelving system 100 incorporating the proposed concept. As can be seen, the shelving system 100 still includes four corner posts 104 but it also includes two intermediary vertical posts 170. Each shelf assembly 102 includes six side rails 106.

Figure 29:
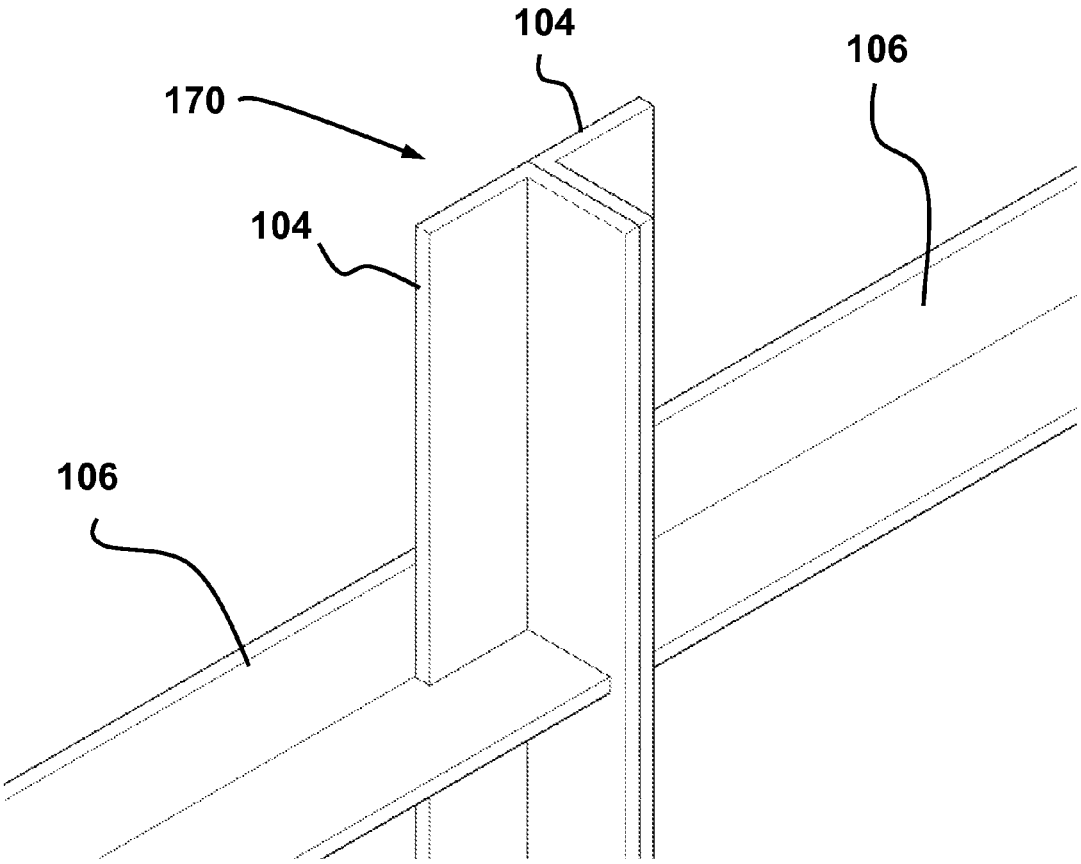
FIG. 29 is an enlarged isometric view of the junction between two adjacent side rails and an intermediary post formed using two juxtaposed corner posts that were rigidly attached together.

FIG. 29 is an enlarged isometric view of the shelving system 100 of FIG. 28. As can be seen, the junction between two adjacent side rails 106 and an intermediary post 170 is formed using two juxtaposed corner posts 104 that were rigidly attached together. They can be attached for instance using fasteners, such as staples, screws, etc., and/or glue. Other suitable fasteners and methods can also be used. Using two juxtaposed corner posts reduces the number of different parts. Nevertheless, one can use another kind of intermediary post, for instance a post pre-manufactured with a T-shaped cross section, thus which is not the combination of two corner posts 104.

Figure 30:
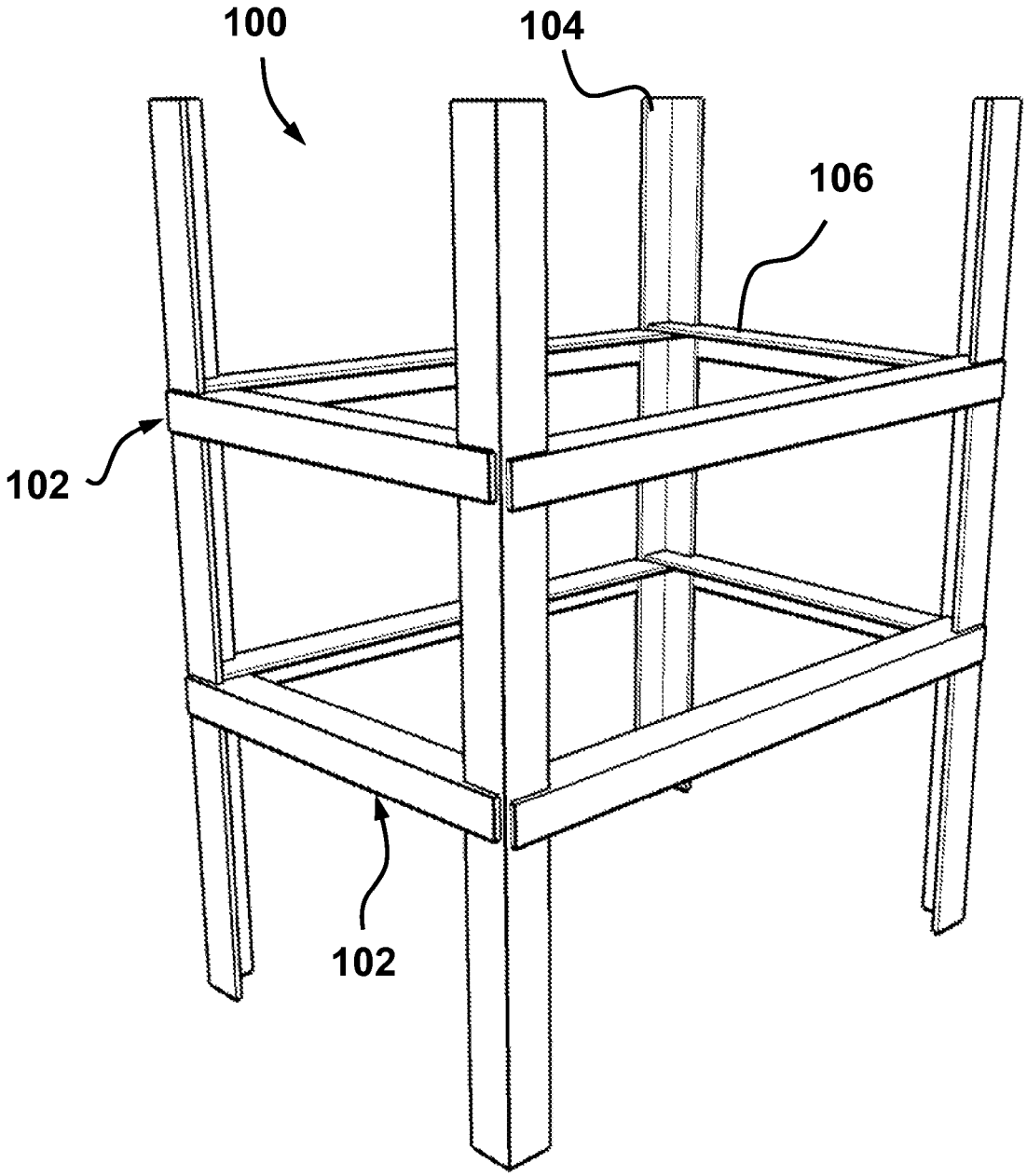
FIG. 30 is an isometric view illustrating another example of a modular shelving system incorporating the proposed concept.
Figure 31:
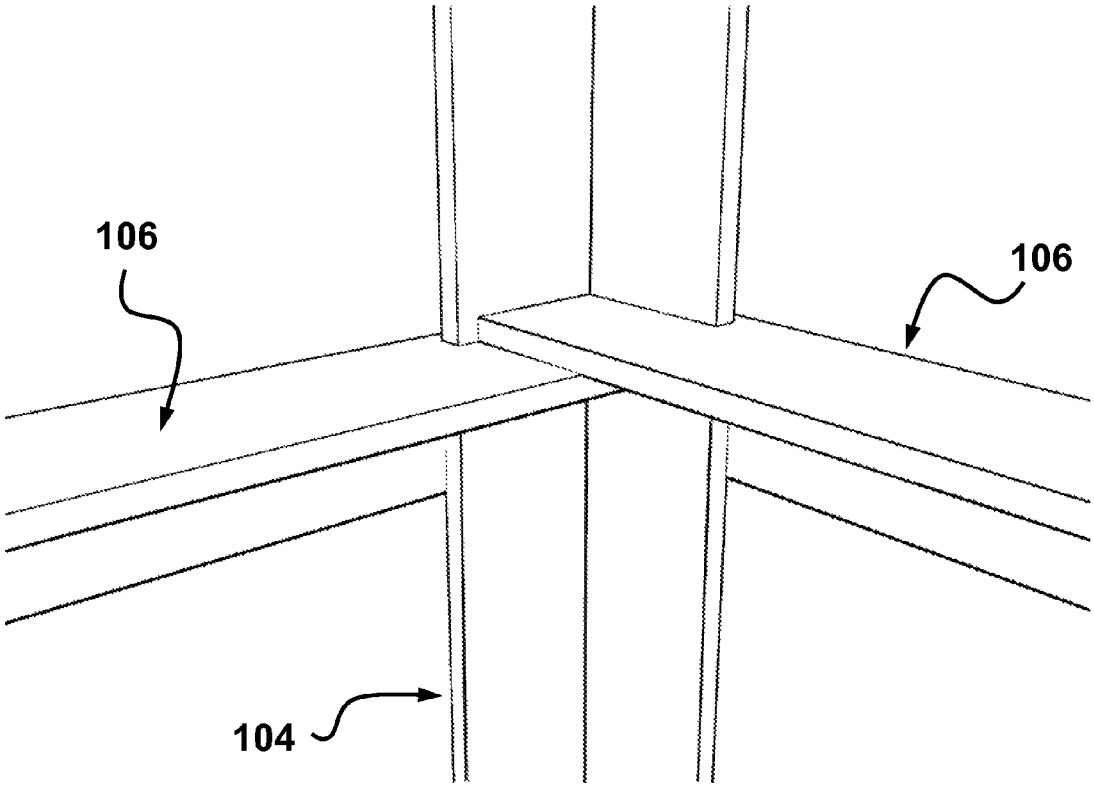
FIG. 31 is an enlarged isometric view of the inner side of one of the corner posts of the shelving system of FIG. 30.

FIG. 30 is an isometric view illustrating another example of a modular shelving system 100 incorporating the proposed concept. FIG. 31 is an enlarged isometric view of the inner side of one of the corner posts 104 of the shelving system 100 of FIG. 30. This shelving system 100 is similar to the one shown in FIG. 1 but is configured upside-down. Thus, the inner side of the side rails 106 is facing downwards. This variant can be used for lightweight implementations.

Figure 32:
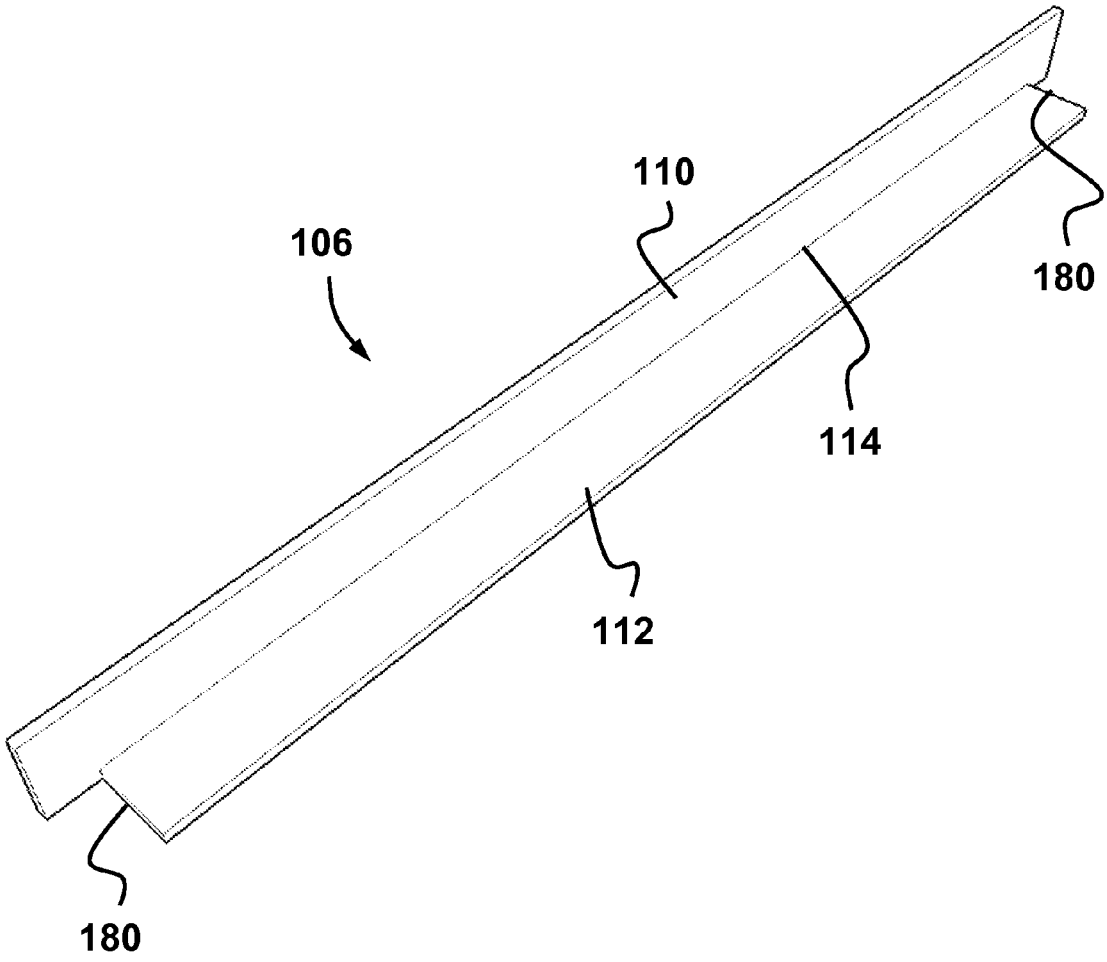
FIG. 32 is an isometric view illustrating an example of a side rail devoid of slot at both ends.

FIG. 32 is an isometric view illustrating an example of a side rail 106 devoid of first through slot at both ends. This variant includes, at each end thereof, a cutaway portion 180 made in the horizontally-projecting side rail strip 112. The vertically-projecting side rail strip 110 of this side rail 106 is thus longer than the corresponding horizontally-projecting side rail strip 112.

Figure 33:
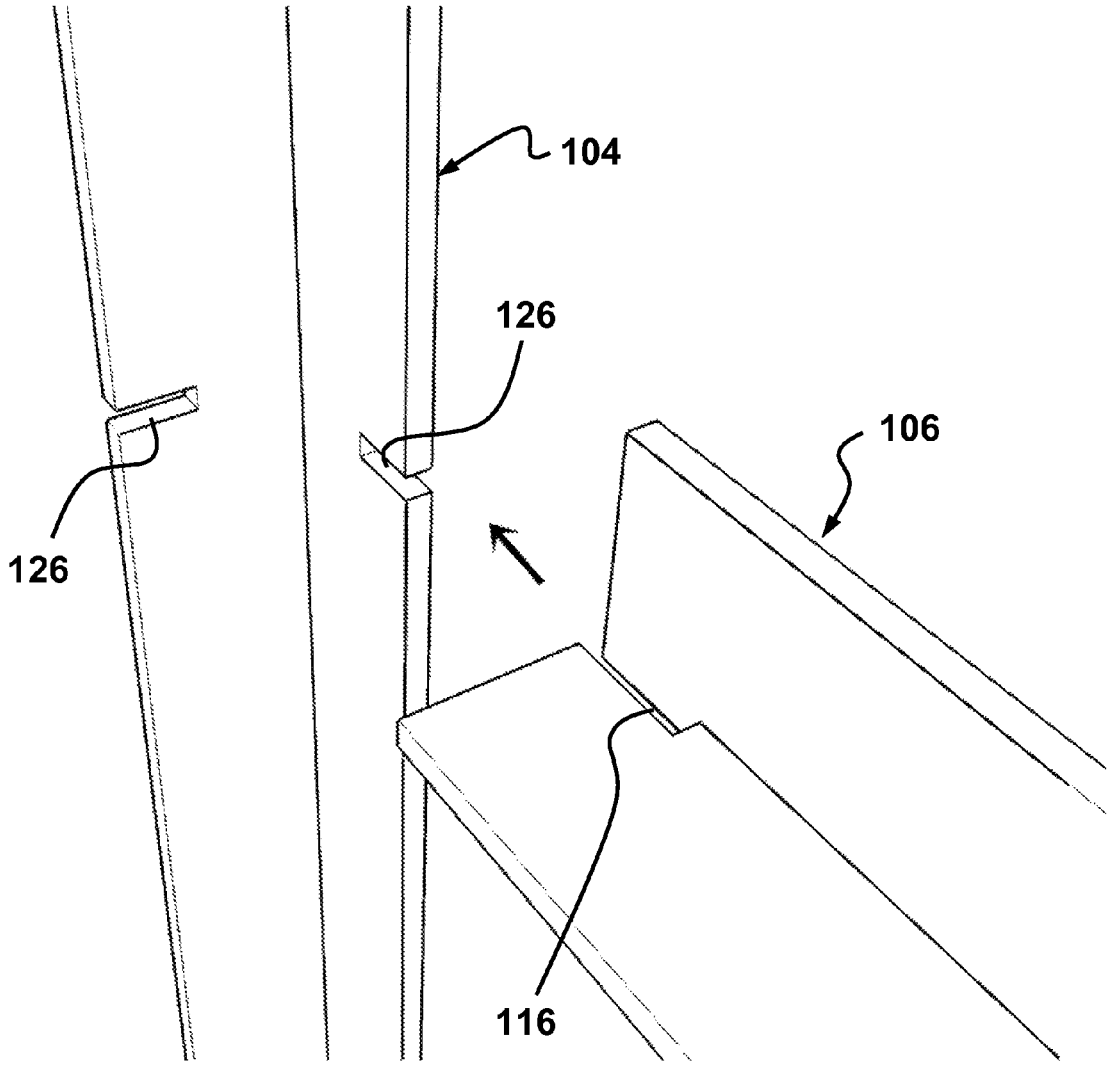
FIG. 33 is an enlarged isometric view illustrating an example of a connection of one of the side rails to one of the corner posts.

FIG. 33 is an enlarged isometric view illustrating an example of a connection of one of the side rails 106 with a first through slot 116 to one of the corner posts 104. The first through slot 116 of the side rail 106 fits into the corresponding second through slot 126 of the corner post 104. This is similar to what is seen for instance in FIG. 4. The side rail 106 will serve as a support for the side rail 106 shown in FIG. 32.

Figure 34:
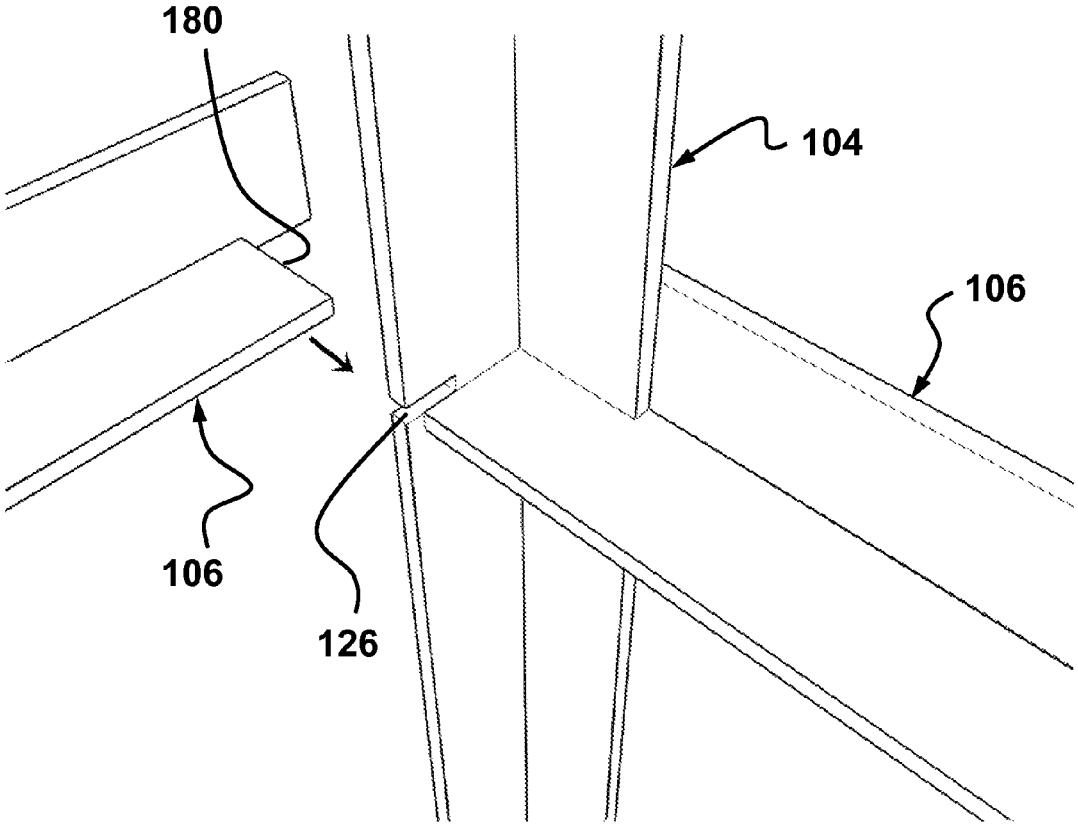
FIG. 34 is an enlarged isometric view illustrating the connection of the side rail of FIG. 32 with the corner post of FIG. 33.

FIG. 34 is an enlarged isometric view illustrating the connection of the side rail 106 of FIG. 32 with the corner post 104 of FIG. 33. As can be seen, the edge portion of the horizontally-projecting side rail strip 112 that is at the corner of the vertically-projecting side rail strip 110 fits into the corresponding second through slot 126 of the corner post 104. This second through slot 126 is vertically offset with the matching second through slot 126 receiving the side rail 106 of about the thickness of the horizontally-projecting side rail strip 112. This way, the bottom surface of the horizontally-projecting side rail strip 112 can rest directly over the top surface of the horizontally-projecting side rail strip 112 of the side rail 106. This overlapping creates a load-bearing engagement.

Figure 35:
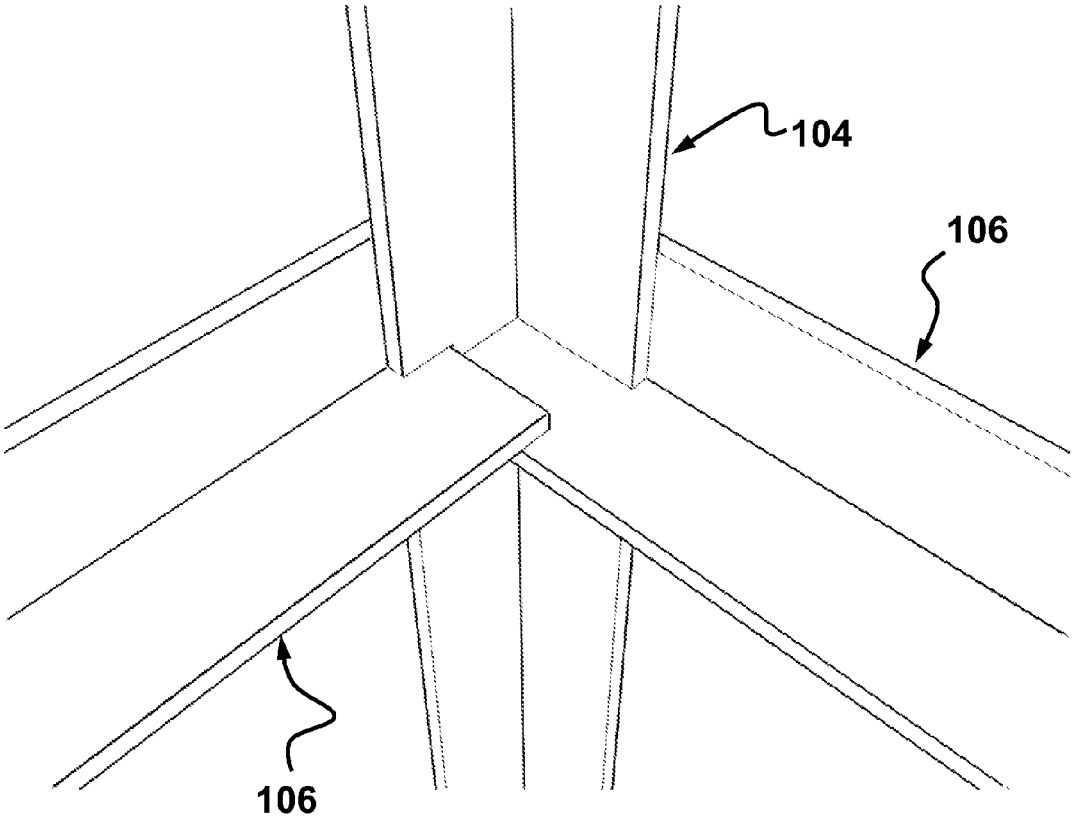
FIG. 35 is an enlarged isometric view of the parts shown in FIG. 34 one connected together.

FIG. 35 is an enlarged isometric view of the parts shown in FIG. 34 one connected together.

It should be noted that in a quadrilateral shelf assembly having two side rails 106 as shown in FIG. 32, these two side rails 106 will be positioned parallel to one another and two side rails 106 with first through slots 116 at each end will be positioned between them. One can also design an implementation where each side rail 106 has one end with a first through slot 116 and an opposite end with a cutaway portion 180.

As aforesaid, the side rails 106 and the corner posts 104 can be rigidly secured using other suitable fasteners or methods. One additional example is shown in FIGS. 36 to 40.

Figure 36:
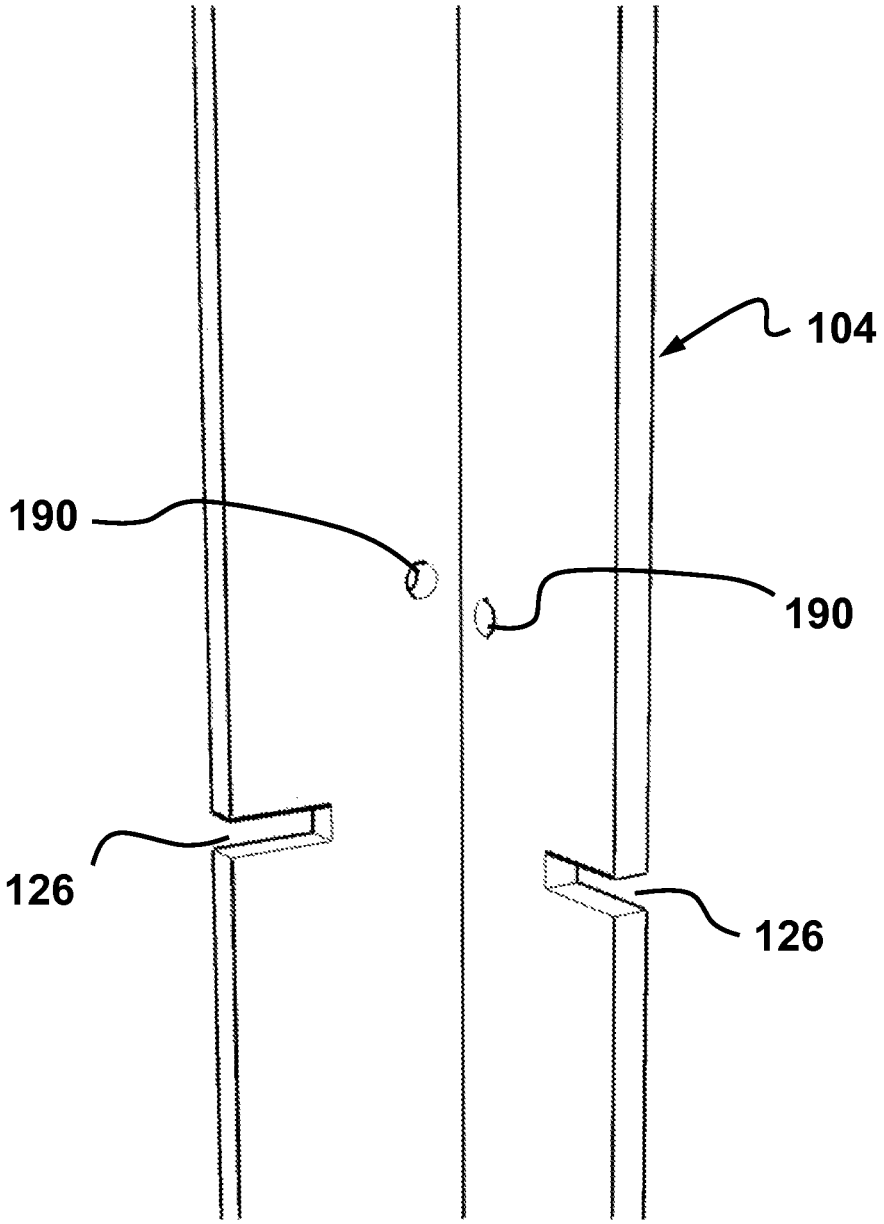
FIG. 36 is an isometric view illustrating an example of a corner post with prefabricated holes for receiving fasteners.

FIG. 36 is an isometric view illustrating an example of a corner post 104 with prefabricated holes 190 for receiving a fastener, such as screws, bolts, nails, dowels, rivets, etc. These holes 190 can be made, for instance, by punching. Variants are possible as well.

Figure 37:
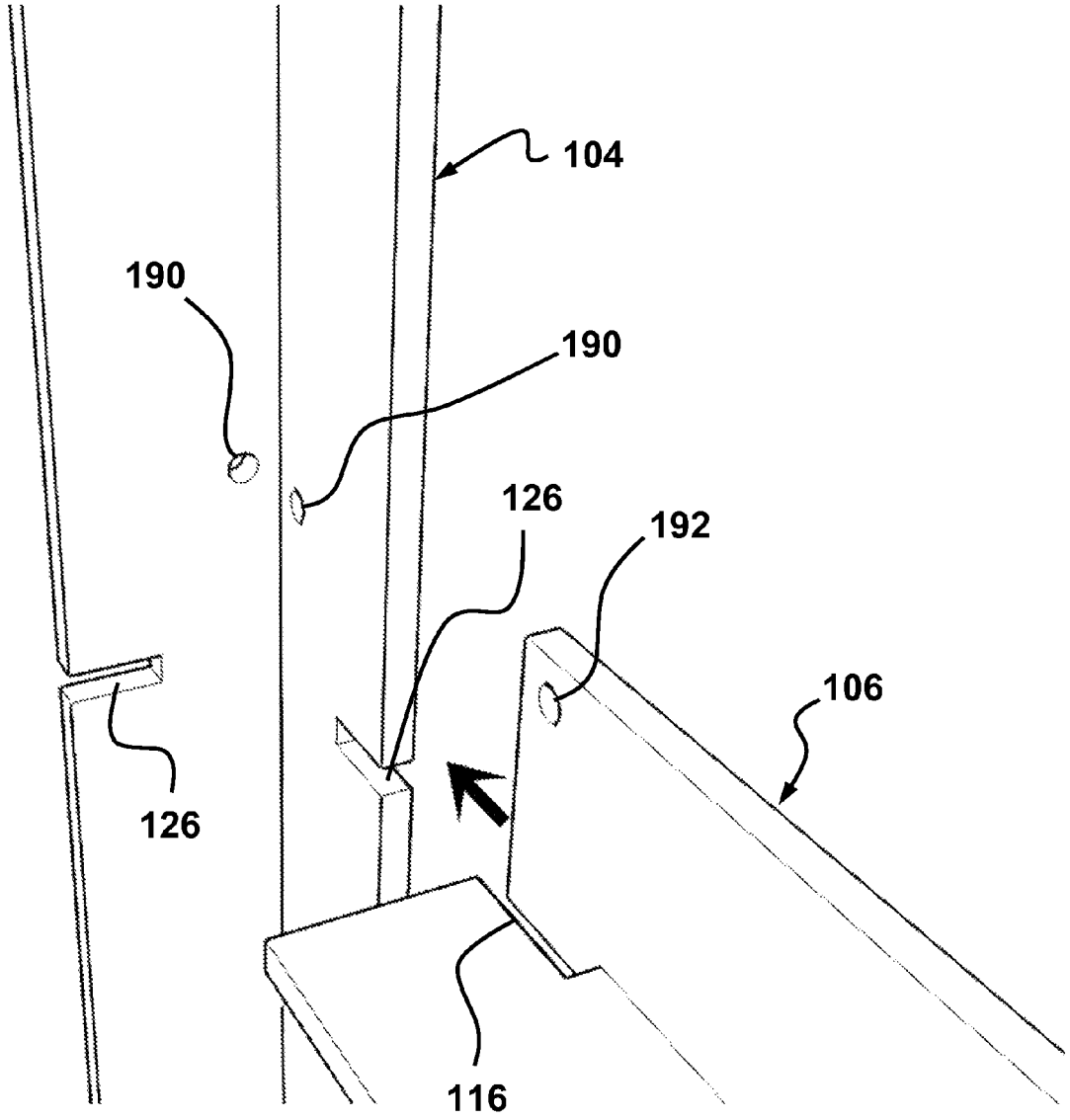
FIG. 37 is an enlarged isometric view illustrating an example of a connection of a side rail to the corner post of FIG. 36.

FIG. 37 is an enlarged isometric view illustrating the connection of a first one of the side rails 106 to the corner post 104 of FIG. 36. The first side rail 106 includes holes 192 that are in registry with the holes 190 of the corner post 104 once the parts are in place.

Figure 38:
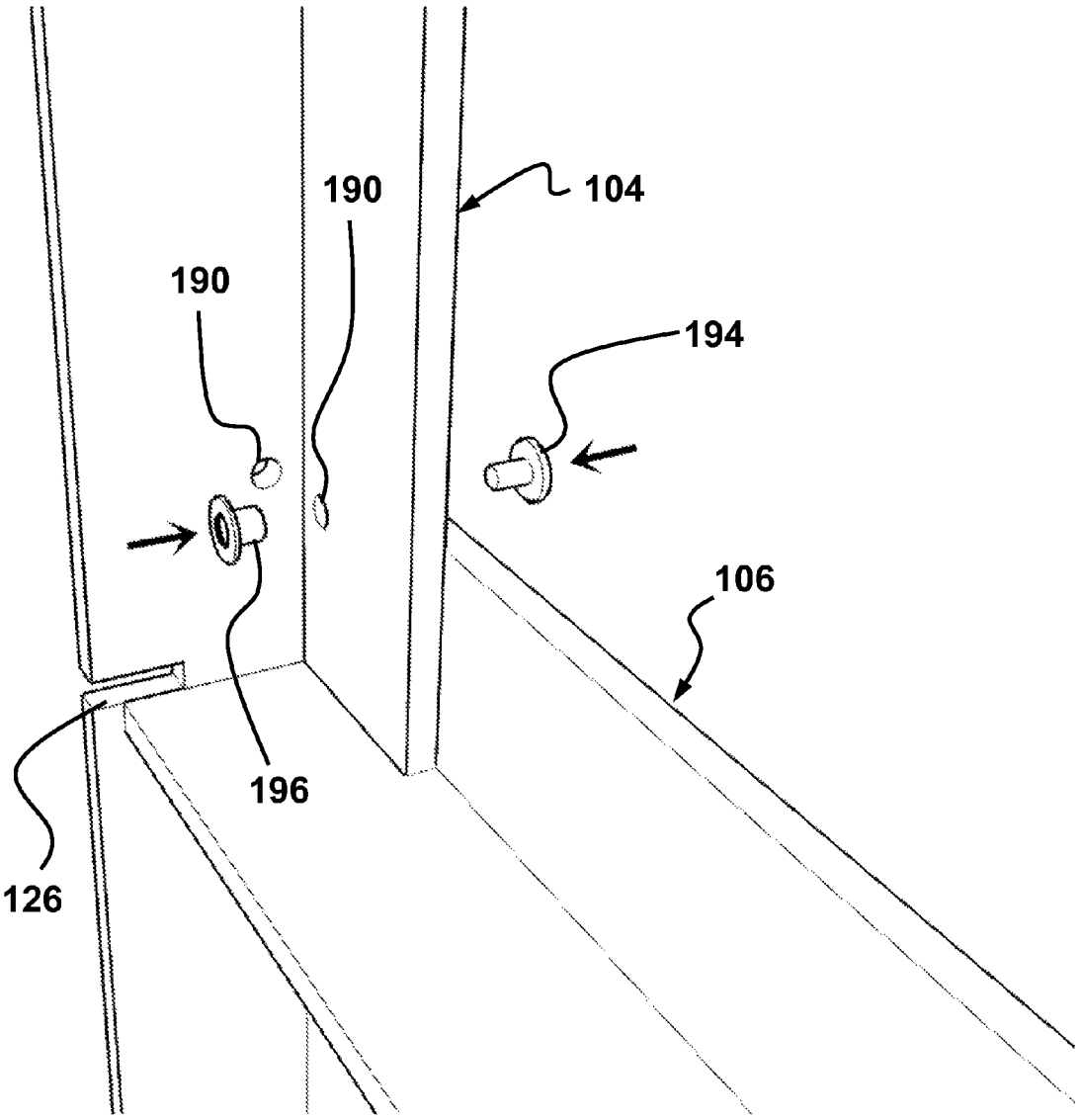
FIG. 38 is an enlarged isometric view illustrating an example of a fastener being installed to secure the first side rail to the corner post of FIG. 37.

FIG. 38 is an enlarged isometric view illustrating an example of a fastener being installed to secure the first side rail 106 to the corner post 104 of FIG. 37. In this example, the fastener includes a screw 194 and a corresponding blind well nut 196. Variants are possible as well.

Figure 39:
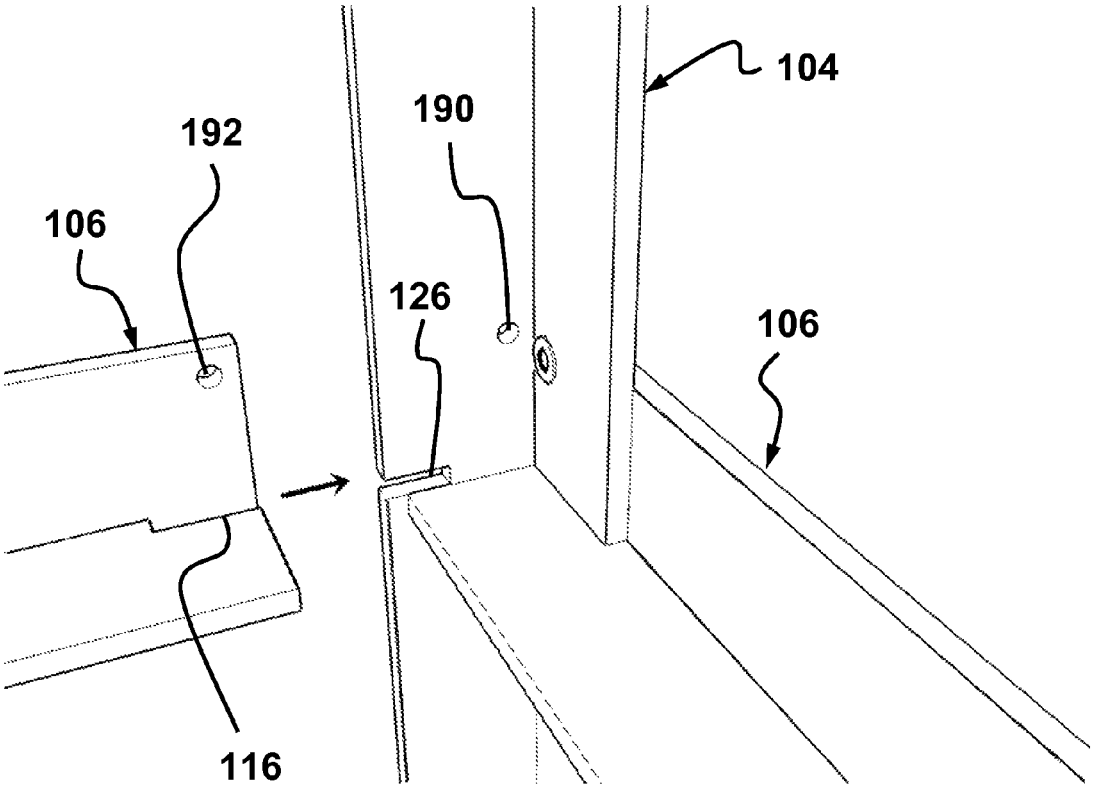
FIG. 39 is an enlarged isometric view illustrating an example of a second side rail being connected to the parts of FIG. 38.

FIG. 39 is an enlarged isometric view illustrating an example of a side rails 106 being connected to the corner post 104 of FIG. 38. This second side rail 106 also includes holes 192.

Figure 40:
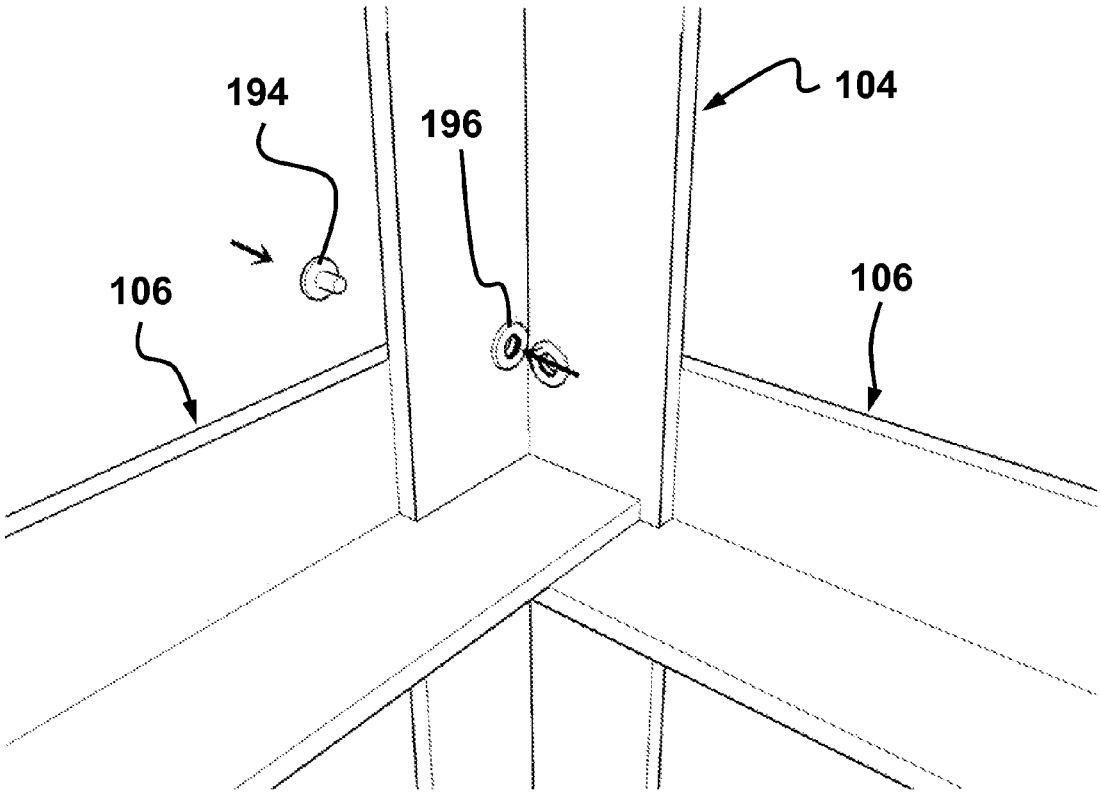
FIG. 40 is an enlarged isometric view illustrating an example of a fastener being installed to secure the second side rail to the corner post of FIG. 39.

FIG. 40 is an enlarged isometric view illustrating an example of a fastener being installed to secure the second side rail 106 to the corner post 104 of FIG. 39. In this example, the fastener also includes a screw 194 and a corresponding blind well nut 196. Variants are possible as well.

As can be appreciated, a modular shelving system constructed as based on the proposed concept requires a very small number of parts and can be assembled very quickly. The configuration of the side rail ends 106 shown in FIG. 1 also increases the loading capacity of the shelving system 100. In use, adding weight on one of the shelf assemblies 102 will increase the tendency of the corresponding side rails 106 of twisting inwards as the weight pushes downwards on the horizontally-projecting side rail strips 112. The position of the ends of the vertically-projecting side rail strips 110, however, will mitigate this buckling tendency since the corner post strips 120 are interlocked with the side rail ends.

The shelving systems incorporating the proposed concept can be used in a wide range of applications and purposes, including for instance fresh cut flowers or plants in their pots. They can be used in transportation, storage and/or display at the point-of-sale, for instance in a store where customers may take the items directly from the shelves. They can be unassembled after use and send back to the point of origin in a compact shipment of piled parts to be used again later. They are attractive, have a clean look, are lightweight, provide an optimum finger space and can be easily and quickly assembled without the need of any special tools or experience, even by a single person. One can even use shelving systems as displays for marketing purposes, for instance in store aisleways, trade-shows, etc., or even as low-cost furniture in residences and/or institutions. Many other uses are possible a well.

If desired, a shelving system incorporating the proposed concept can be made using side rails that are all identical to one another and using corner posts that are all identical to one another. Thus, only one model of side rail and only one model of corner post are used for forming a shelving system for ease of manufacture, inventory and assembly. Nevertheless, one can design the shelving system with two or more models of side rails and/or with two or more models of corner posts, for instance a left-side model and a right-side model. Other variants are possible as well.

The present detailed description and the appended figures are meant to be exemplary only, and a skilled person will recognize that many changes can be made while still remaining within the proposed concept. For instance, the corners posts and/or the side rails can be asymmetric, i.e. having one slat larger than the other one. Many different configurations of shelving systems are possible, depending on the needs. Although the ones using quadrilateral shelf assemblies will be suitable for most users, it is possible to have shelving systems where only three corner posts are provided. The strips of these corners posts can be at 120 degrees from one another instead of being at right angle. One can also design a shelving system where one or more of the side raids are not rectilinear, for instance being curved. Still, one can design a shelving system with corner posts that are not having the same length, for instance to be used on a non-planar surface. Other variants are possible as well.

LIST OF THE REFERENCE NUMERALS

100 shelving system
102 shelf assembly
104 corner post
106 side rail
108 board
110 vertically-projecting side rail strip
112 horizontally-projecting side rail strip
114 common junction
116 first through slot
120 corner post strip
122 common junction
124 side edge
126 second through slot
130 staple
140 pallet
142 bottom plank
144 ledge
146 staple
148 corner block
150 pallet
152 staple
154 bottom plank
160 beveled tip
170 intermediary vertical post
180 cutaway portion
190 hole (in corner post)
192 hole (in side rail)
194 fastener
196 blind well nut

What is claimed is:

1. A modular shelving system including:

at least one shelf assembly, the shelf assembly including a plurality of elongated horizontally-extending side rails, each side rail having two opposite ends and a body that is formed by two substantially perpendicular and flat strips integrally connected to one another along a common junction, one of the strips of each side rail being a vertically-projecting side rail strip and the other one being a horizontally-projecting side rail strip, each side rail further including an inner side and an outer side, at least some of the side rails including at least one open-ended first through slot, each first through slot extending lengthwise on the horizontally-projecting side rail strip along the common junction from a corresponding one of the ends of each side rail; and a plurality of elongated vertically-extending corner posts to which the ends of the side rails are connected to form a self-standing skeletal structure, each corner post having two opposite ends, an inner side, an outer side and a body that is formed by two substantially flat strips integrally connected to one another along a common junction, each strip of the corner posts having a side edge extending lengthwise and at least one open-ended second through slot located at a given distance in-between the ends of each corner post and that extends perpendicularly from the side edge towards the common junction of the corner post, each first through slot forming a detachable interdigitated and load-bearing engagement with a corresponding one of the second through slots to support the shelf assembly.

2. The shelving system as defined in claim 1, wherein the shelf assembly is quadrilateral and the side rails of the shelf assembly are at least four in number, the corner posts of the shelving system being four in number.

3. The shelving system as defined in claim 2, wherein the strips of each corner post are positioned at right angle from one another.

4. The shelving system as defined in claim 1, wherein the shelving system includes more than one of the shelf assembly and each strip of the corner posts includes more than one second through slot, the second through slots on each strip of the corner posts being laterally aligned with a corresponding opposite one of the second through slots to form a pair, the pairs of second through slots being spaced apart from one another and at least in equal number to the number of shelf assemblies.

5. The shelving system as defined in claim 1, wherein at least some of the side rails include a beveled tip on the horizontally-projecting side rail strip.

6. The shelving system as defined in claim 4, wherein the second through slots of each pair are vertically offset from one another by a distance that substantially corresponds to a thickness of the horizontally-projecting side rail strip.

7. The shelving system as defined in claim 6, wherein at least some of the side rails include a cutaway portion on the horizontally-projecting side rail strip.

8. The shelving system as defined in claim 6, wherein the horizontally-projecting side rail strips of two adjacent ones of the side rails are overlapping on the inner side of the corresponding corner post.

9. The shelving system as defined in claim 1, wherein each end of the side rails includes a corresponding one of the first through slots.

10. The shelving system as defined in claim 1, wherein the engagement between the first through slots and the second through slots includes an interference fit.

11. The shelving system as defined in claim 1, wherein the corner posts and the side rails are also rigidly secured together with fasteners.

12. The shelving system as defined in claim 11, wherein the fasteners include at least one staple provided through each end of the side rails and the corresponding corner post.

13. The shelving system as defined in claim 1, wherein the corner posts include prefabricated holes and the side rails include prefabricated holes, the holes on the corner posts being in registry with corresponding ones of the holes on the side rails once the shelving system is assembled to receive fasteners.

14. The shelving system as defined in claim 13, wherein bottom ends of the corner posts are rigidly secured to corresponding sides of a pallet.

15. The shelving system as defined in claim 14, wherein the bottom ends of the corner posts are spaced apart from a floor over which the pallet rests.

16. The shelving system as defined in claim 15, wherein the bottom ends of the corner posts engage an upper side of corresponding ledges outwardly extending from a bottom side of the pallet.

17. The shelving system as defined in claim 16, wherein the pallet further includes four spaced-apart alignment corner blocks attached under the ledges of the pallet.

18. The shelving system as defined in claim 1, wherein the shelving system includes at least one intermediary vertical post to which some of the side rails are connected.

19. The shelving system as defined in claim 18, wherein the intermediary vertical post is made of two additional corner posts that are juxtaposed to one another.

20. The shelving system as defined in claim 19, wherein the intermediary vertical post has a T-shaped cross section.

21. The shelving system as defined in claim 1, wherein the shelf assembly further includes a board that is supported by the horizontally-projecting side rail strips.

22. The shelving system as defined in claim 1, wherein each of the corner posts is made of a one-piece material.

23. The shelving system as defined in claim 1, wherein each of the side rails is made of a one-piece material.

24. The shelving system as defined in claim 23, wherein the one-piece material is a material made of laminated layers of fiberboard, paperboard and/or cardboard.

25. The shelving system as defined in claim 1, wherein the side rails are identical from one another and the corner posts are identical from one another.

26. The shelving system as defined in claim 25, wherein the first through slots and the second through slots each have a periphery that is substantially rectilinear and that is substantially rectangular in cross section.

* * * * *